US009520092B2

(12) United States Patent
Iwasa

(10) Patent No.: US 9,520,092 B2
(45) Date of Patent: Dec. 13, 2016

(54) LIQUID CRYSTAL DISPLAY

(71) Applicant: JVC KENWOOD Corporation, Yokohama-shi, Kanagawa (JP)

(72) Inventor: Takayuki Iwasa, Yokohama (JP)

(73) Assignee: JVC Kenwood Corporation, Yokohama-shi (JP)

( * ) Notice: Subject to any disclaimer, the term of this patent is extended or adjusted under 35 U.S.C. 154(b) by 265 days.

(21) Appl. No.: 14/028,818

(22) Filed: Sep. 17, 2013

(65) Prior Publication Data

US 2014/0078195 A1 Mar. 20, 2014

(30) Foreign Application Priority Data

Sep. 18, 2012 (JP) ..... 2012-204289

(51) Int. Cl.
*G09G 3/36* (2006.01)
*G09G 3/20* (2006.01)

(52) U.S. Cl.
CPC ..... *G09G 3/3607* (2013.01); *G09G 3/2022* (2013.01); *G09G 3/3655* (2013.01); *G09G 3/3688* (2013.01); *G09G 2300/0842* (2013.01); *G09G 2300/0857* (2013.01); *G09G 2320/0271* (2013.01)

(58) Field of Classification Search
CPC .. G09G 3/3648; G09G 3/3614; G09G 3/2022; G09G 2300/0857; G09G 2300/0842
See application file for complete search history.

(56) References Cited

U.S. PATENT DOCUMENTS 5,349,366 A * 9/1994 Yamazaki ..... G09G 3/3648 345/206
5,712,652 A * 1/1998 Sato ..... G06F 3/03542 345/204

(Continued)

FOREIGN PATENT DOCUMENTS

JP 56-053487 A 5/1981
JP 2000148065 A 5/2000

(Continued)

OTHER PUBLICATIONS

Official Action issued Feb. 23, 2016 in the counterpart Japanese application No. 2012-204289.

*Primary Examiner* — Dorothy Harris
(74) *Attorney, Agent, or Firm* — Nath, Goldberg & Meyer; Jerald L. Meyer; Stanley Protigal

(57) ABSTRACT

A liquid crystal display includes a pixel circuit having a first hold unit, a second hold unit, a transfer control unit and a pixel unit. The first hold unit selectively holds a higher or lower driving voltage which is arbitrarily set between a ground potential and a power-supply voltage, according to a row selection signal from a vertical scanning unit and a logical value of data from a horizontal scanning unit. The second hold unit selectively holds the higher or lower driving voltage held in the first hold unit. The transfer control unit transfers to the second hold unit, the higher or lower driving voltage held in the first hold unit according to a trigger pulse. The pixel unit drives a liquid crystal according to a potential difference between the higher or lower driving voltage held in the second hold unit and a voltage supplied to a common electrode thereof.

7 Claims, 9 Drawing Sheets

(56) References Cited

U.S. PATENT DOCUMENTS 5,798,746 A * 8/1998 Koyama ..... G02F 1/13624 345/89
5,959,598 A * 9/1999 McKnight ..... G06T 3/40 345/87
6,005,558 A * 12/1999 Hudson ..... G09G 3/3614 345/204
6,225,991 B1 * 5/2001 McKnight ..... G06T 3/40 345/205
6,451,640 B1 * 9/2002 Ichikawa ..... H01L 21/823892 257/E21.644
7,663,578 B2 * 2/2010 Miyake ..... G09G 3/3258 315/169.3
8,049,702 B2 * 11/2011 Miyazawa ..... G09G 3/3659 345/100
2001/0005193 A1 * 6/2001 Yokoyama ..... G09G 3/2011 345/92
2001/0052890 A1 * 12/2001 Miyazawa ..... G09G 3/3659 345/89
2002/0075252 A1 * 6/2002 Lee ..... G09G 3/3659 345/211
2002/0084967 A1 * 7/2002 Akimoto ..... G09G 3/3648 345/90
2004/0196235 A1 * 10/2004 Koyama ..... G09G 3/3607 345/89
2004/0263502 A1 * 12/2004 Dallas ..... G02F 1/133553 345/204
2008/0238850 A1 * 10/2008 Watanabe ..... G09G 3/3614 345/90

FOREIGN PATENT DOCUMENTS

JP 2002140052 A 5/2002
JP 2002297082 A 10/2002
JP 2004200300 A * 7/2004

* cited by examiner

LIQUID CRYSTAL DISPLAY

CROSS REFERENCE TO RELATED APPLICATION

This application claims benefit of priority under 35 U.S.C. §119 to Japanese Patent Application No. 2012-204289, filed on Sep. 18, 2012, the entire contents of which are incorporated by reference herein.

BACKGROUND

The present invention relates to a digital driven type liquid crystal display that performs an image display based on a digital gradation signal.

In the digital driven type liquid crystal display, each frame in a video signal to be displayed is composed of a plurality of sub-frames each having a display period shorter than one frame period. Each of sub-frames is selectively turned on or off by plural pieces of sub-frame data which are digital signals, according to a gradation to be displayed, wherein each piece of the sub-frame data has 1-bit value. Thereby, respective pixels are driven by the combination of sub-frames associated with a gradation at which an image in one frame is to be displayed.

As the digital driven type liquid crystal display, for example, Patent Literature 1 (Japanese Patent Application Laid-Open Publication No.S56(1981)-53487) has been known. In Patent Literature 1, a ground potential and a power-supply voltage are applied to both ends of a liquid crystal cell forming each pixel, which drives the liquid crystal cell. Namely, driving voltages which drive the liquid crystal cell are fixed to the ground potential and the power-supply voltage. Due to this, there is a problem that any driving voltage other than the ground potential and the power-supply voltage can not be applied to each pixel.

SUMMARY

The present invention has an object to provide a digital driven type liquid crystal display capable of applying to each pixel, a voltage between a ground potential and a power-supply voltage as a pixel driving voltage.

According to a first aspect of the present invention, there is provided a liquid crystal display including: a display configured to drive pixel circuits to display an image of one frame according to a gradation to be displayed, by combination of sub-frames each of which has a display period shorter than one frame period, wherein the pixel circuits are arranged on cross-points where each of column data lines interests row scanning lines; a horizontal scanning unit configured to sequentially output to the column data lines by one horizontal scanning period unit, data associated with the image of one frame; a vertical scanning unit configured to output a row selection signal for sequentially selecting the row scanning lines one by one by one horizontal scanning period unit; and a trigger pulse generator configured to output a trigger pulse to the pixel circuits in common, wherein each of the pixel circuits includes: a first hold unit configured to selectively hold a higher or lower driving voltage which is arbitrarily set between a ground potential and a power-supply voltage, according to the row selection signal output from the vertical scanning unit and a logical value of the data output from the horizontal scanning unit; a second hold unit configured to selectively hold the higher or lower driving voltage held in the first hold unit; a transfer control unit configured to transfer to the second hold unit, the higher or lower driving voltage held in the first hold unit according to the trigger pulse; and a pixel unit configured to drive a liquid crystal according to a potential difference between the higher or lower driving voltage held in the second hold unit and a voltage supplied to a common electrode thereof.

According to a second aspect of the present invention, there is provided a liquid crystal display including: a display configured to drive pixel circuits to display an image of one frame according to a gradation to be displayed, by combination of sub-frames each of which has a display period shorter than one frame period, wherein the pixel circuits are arranged on cross-points where each of column data lines interests row scanning lines; a horizontal scanning unit configured to sequentially output to the column data lines by one horizontal scanning period unit, data associated with the image of one frame; and a vertical scanning unit configured to output a row selection signal for sequentially selecting the row scanning lines one by one by one horizontal scanning period unit, wherein each of the pixel circuits includes: a first hold unit configured to selectively hold a higher or lower driving voltage which is arbitrarily set between a ground potential and a power-supply voltage, according to the row selection signal output from the vertical scanning unit and a logical value of the data output from the horizontal scanning unit; and a pixel unit configured to drive a liquid crystal according to a potential difference between the higher or lower driving voltage held in the first hold unit and a voltage supplied to a common electrode thereof.

According to the present invention, the digital driven type liquid crystal display can apply to each pixel, a voltage between a ground potential and a power-supply voltage as a pixel driving voltage.

DESCRIPTION OF THE EMBODIMENTS

Exemplary embodiments of the present invention will be described below with reference to FIGS. 1 to 9.

First Exemplary Embodiment

Figure 1:
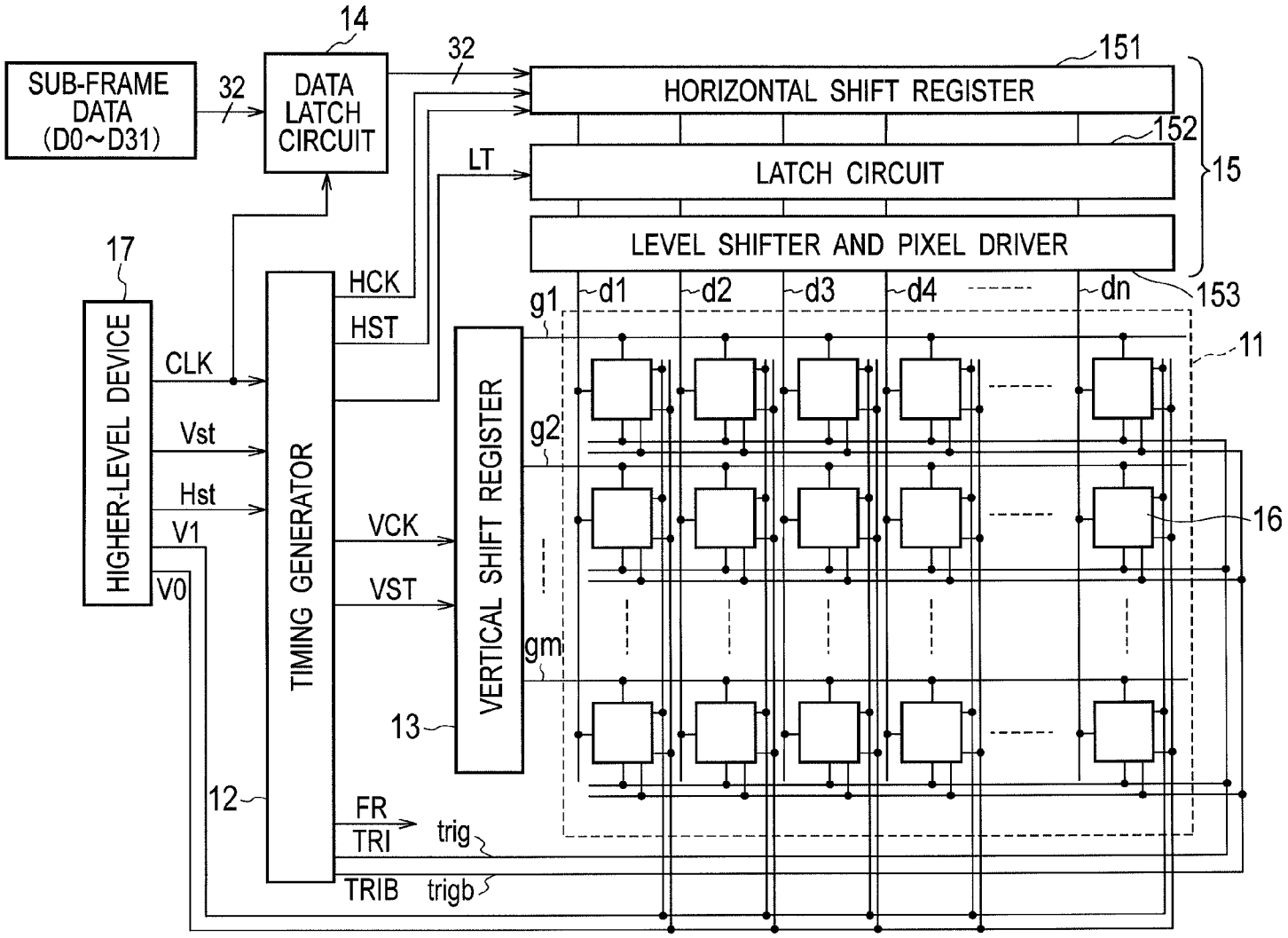
FIG. 1 is a diagram that illustrates the whole configuration of a liquid crystal display according to a first exemplary embodiment of the present invention.

The configuration of a liquid crystal display according to the present embodiment will be described with reference to FIG. 1. In FIG. 1, the liquid crystal display includes a display 11, a timing generator 12, a vertical shift register 13, a data latch circuit 14 and a horizontal driver 15. The horizontal driver 15 includes a horizontal shift register 151, a latch circuit 152 and a level shifter and pixel driver 153.

The display 11 includes a plurality of pixel circuits {(n×m) pixel circuits} 16 which are arranged in a matrix in a plane on cross-points where each of n-column date lines d1 to do intersects m-row scanning lines g1 to gm.

The display 11 forms each frame in a video signal to be displayed using a plurality of sub-frames each having a display period shorter than one frame period. The display 11 drives the pixel circuits 16 using plural pieces of sub-frame data which are digital signals, based on a gradation at which the sub-frames are to be displayed. Thereby, an image is displayed by the combination of sub-frames based on a gradation at which an image in one frame is to be displayed.

The detailed configuration of each pixel circuit 16 will be described later. A normal trigger line "trig" and an inverted trigger line "trigb" are commonly connected to all pixel circuits 16 of the display 11.

The normal trigger line "trig" is connected to a timing generator 12 at one end thereof, and transfers a normal trigger pulse TRI to the pixel circuits 16. The inverted trigger line "trigb" is connected to the timing generator 12 at one end thereof, and transfers an inverted trigger pulse TRIB to the pixel circuits 16. The normal trigger pulse TRI always has a logical value opposite to one of the inverted trigger pulse TRIB.

A lower driving power-supply line V0L and a higher driving power-supply line V1L are commonly connected to all pixel circuits 16 of the display 11. The lower driving power-supply line V0L is connected at one end thereof to a higher-level device 17 which is mounted outside the liquid crystal display, and applies to the pixel circuits 16, a lower driving voltage V0 output from the higher-level device 17. The higher driving power-supply line V1L is connected to the higher-level device 17 at one end thereof, and applies to the pixel circuits 16, a higher driving voltage V1 output from the higher-level device 17.

Although FIG. 1 shows n-column data lines d1 to do as column data lines, n-pairs of column date lines each pair of which has a column data line for normal data and a column data line for inverted data may be used. In this case, normal data which is 1-bit data to be transmitted through the column data line for normal data always has a logical value opposite to one of inverted data which is 1-bit data to be transmitted through the column data line for inverted data. They have mutual complementary relationship.

Although FIG. 1 shows two trigger lines which are the normal trigger line "trig" and the inverted trigger line "trigb", one trigger line may be used.

A vertical synchronizing signal Vst, a horizontal synchronizing signal Hst and a basic clock CLK are input to the timing generator 12. These signals are supplied from the higher-level device 17.

The timing generator 12 generates an alternating current signal FR, a start pulse VST, a start pulse HST, clock signals VCK and HCK and a latch pulse LT. The timing generator 12 also generates the normal trigger pulse TRI and the inverted trigger pulse TRIB, and functions as a trigger pulse generating circuit.

The alternating current signal FR is a signal in which a polarity in the first half section in one frame is opposite to one in the last half section in one frame. The alternating current signal FR is supplied as a common electrode voltage Vcom, to common electrodes of pixel parts forming the pixel circuits 16.

The start pulse VST is a pulse signal which is output at start timing of each sub-frame. The start pulse VST controls switching of sub-frames. The start pulse HST is a pulse signal which is output at start timing when sub-frame data is input into the horizontal shift register 151.

The clock signal VCK is a shift clock signal which defines one horizontal scanning period (1H) in the vertical shift register 13. The vertical shift register 13 performs a shift operation at timing of the clock signal VCK. The clock signal HCK is a shift clock signal which shifts data with 32-bits width in the horizontal shift register 151.

The latch pulse LT is a pulse signal which is output at timing when the horizontal shift register 151 finishes shifting data corresponding to the number of pixels on one row in the horizontal direction. The normal trigger pulse TRI and the inverted trigger pulse TRIB are pulse signals which are supplied to the pixel circuits 16.

The vertical shift register 13 is connected to the row scanning lines g1 to gm. The vertical shift register 13 sequentially transfers the start pulse VST which is first output in each sub-frame, to the row scanning lines g1 to gm according to the clock signal "VCK". Thereby, the vertical shift register 13 sequentially and exclusively supplies a row scanning signal to the row scanning lines g1 to gm by 1H (one horizontal scanning period) unit. The vertical shift register 13 sequentially selects the row scanning lines g1 to gm by 1H unit one by one. The vertical shift register 13 functions as a vertical scanning unit which outputs a row selection signal for sequentially selecting a plurality of row scanning lines by one horizontal scanning period unit one by one.

The data latch circuit 14 latches data with 32-bits width generated by sectioning one sub-frame supplied from an external circuit (not shown), according to the basic clock CLK. The data latch circuit 14 outputs the latched data to the horizontal shift register 151 in synchronization with the basic clock CLK.

The external circuit generates plural pieces of sub-frame data, wherein each piece of the sub-frame data has 1-bit value which is a unit in each sub-frame. The external circuit supplies 32 pieces of sub-frame data corresponding to 32 pixels in the same sub-frame, to the data latch circuit 14 as data with 32-bits width.

The horizontal driver 15 is connected to the column data lines d1 to dn. The horizontal driver 15 sequentially outputs each piece of sub-frame data having 1-bit value, which is a unit in each sub-frame, for each associated pixel circuit 16, to the column data lines d1 to dn by one horizontal scanning period unit. Thereby, the horizontal driver 15 functions as a horizontal scanning unit which sequentially outputs digital data to a plurality of column data lines d1 to dn by one horizontal scanning period unit.

The horizontal shift register 151 starts shift based on the start pulse HST, and shifts 32 pieces of sub-frame data with 32-bits width supplied from the data latch circuit 14 in synchronization with the clock signal HCK. The horizontal shift register 151 stores n-pieces of sub-frame data having n-bit values associated with n-pixel circuits 16 on one row.

The latch circuit 152 collectively latches n-pieces of sub-frame data having n-bit values stored in the horizontal shift register 151 according to the latch pulse LT.

The level shifter and pixel driver 153 shifts each of voltages of n-pieces of sub-frame data latched by the latch circuit 152, to a voltage at which each associated pixel circuit 16 works. For example, the level shifter and pixel driver 153 shifts each of voltages of n-pieces of sub-frame data of about 1.2V, to about 3.3V which is a power-supply voltage of the present device. The level shifter and pixel driver 153 outputs n-pieces of sub-frame data having n-bit values which are subject to level-shift, to the associated n-column data lines d1 to dn.

The horizontal shift driver 15 causes the latch circuit 152 to latch n-pieces of sub-frame data stored in the horizontal shift register 151 in the current one horizontal scanning period, and then loads sequential n-pieces of sub-frame data in a next one horizontal scanning period into the horizontal shift register 151 and performs level shift. Thereby, in one horizontal scanning period, the horizontal driver 15 performs a work for outputting the current n-pieces of sub-frame data to the associated pixel circuits 16 and a work for loading the sequential n-pieces of sub-frame data, in parallel.

Figure 2:
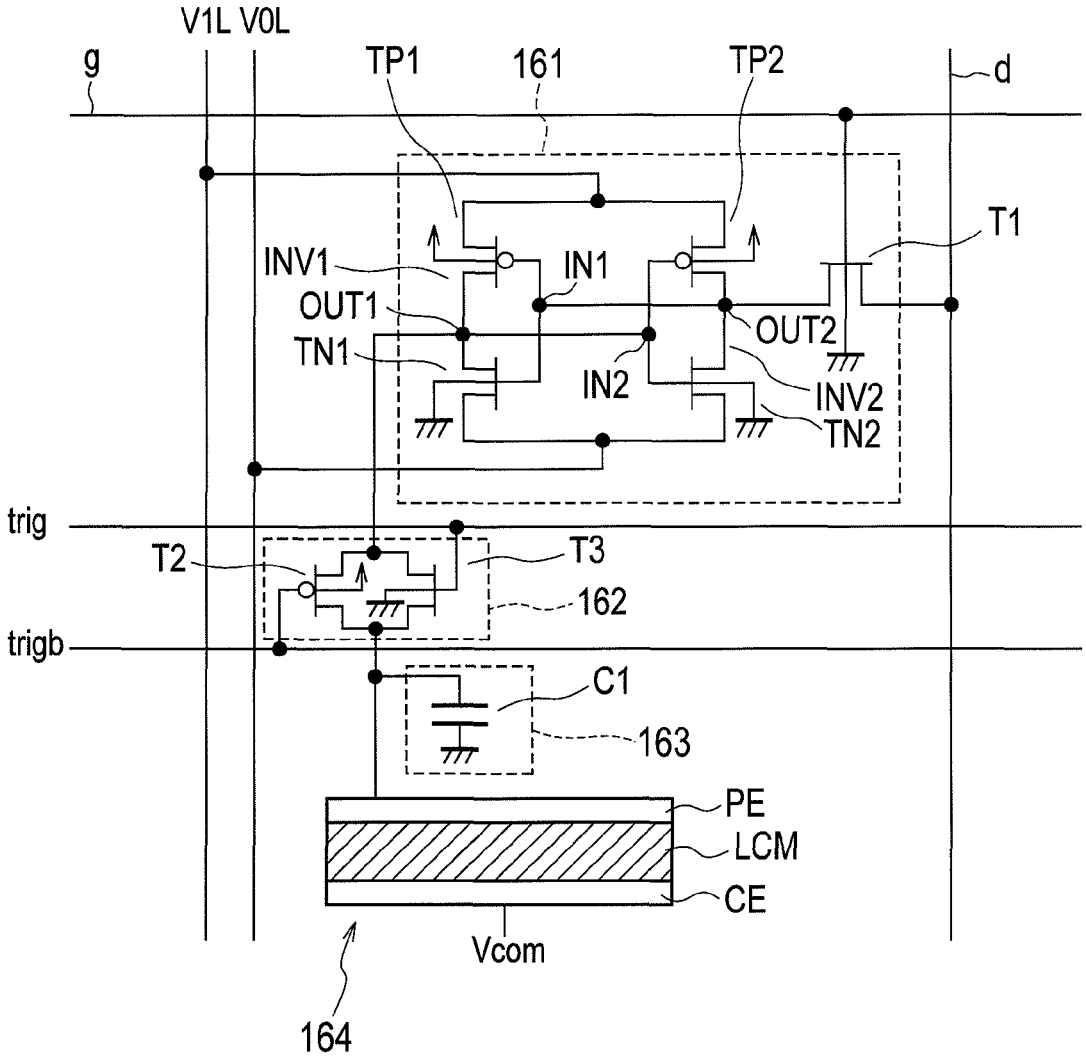
FIG. 2 is a diagram that illustrates a circuit configuration in a pixel circuit according to the first exemplary embodiment of the present invention.

As a representative for the plurality of pixel circuits 16 arranged in a matrix in a plane shown in FIG. 1, a pixel circuit 16 shown in FIG. 2 is cited, and the configuration of the pixel circuit 16 shown in FIG. 2 will be described.

The pixel circuit 16 shown in FIG. 2 is one pixel circuit which is arranged at a cross-point where one column data line "d" among the column data lines d1 to dn intersect one row scanning line "g" among the row scanning lines g1 to gm.

The pixel circuit 16 includes a first hold unit 161, a transfer control unit 162, a second hold unit 163 and a pixel unit 164.

The first hold unit 161 includes a first transistor T1, a first inverter INV1 and a second inverter INV2.

The first transistor T1 is a MOS type N-channel transistor. The first transistor T1 has a gate terminal connected to the row scanning line g, a drain terminal connected to the column data line d, and a source terminal connected to an input terminal IN1 of the first inverter INV1 and an output terminal OUT2 of the second inverter INV2. The first transistor T1 is electrical-connect controlled according to a row scanning signal to be input to the gate terminal through the row scanning line g to electrically connect the column data line d with the output terminal OUT2 of the second inverter INV2.

The first inverter INV1 has the input terminal IN1 connected to the output terminal OUT2 of the second inverter INV2 and the source terminal of the first transistor T1, and an output terminal OUT1 connected to an input side of the transfer control unit 162.

The second inverter INV2 has an input terminal IN1 connected to the output terminal OUT1 of the first inverter INV1 and the input side of the transfer control unit 162, and the output terminal OUT2 connected to the input terminal IN1 of the first inverter INV1 and the source terminal of the first transistor T1.

The first inverter INV1 and the second inverter INV2 constitute a self-holding storage circuit with the above-described connection configuration.

The first inverter INV1 includes transistors TP1 and TN1. The transistor TP1 is a MOS type p-channel transistor. The transistor TN1 is a MOS type N-channel transistor. The transistors TP1 and TN1 have gate terminals commonly connected to each other and drain terminals commonly connected to each other.

The second inverter INV2 includes transistors TP2 and TN2. The transistor TP2 is a MOS type p-channel transistor. The transistor TN2 is a MOS type N-channel transistor. The transistors TP2 and TN2 have gate terminals commonly connected to each other and drain terminals commonly connected to each other.

A higher power-source voltage VDD used in the liquid crystal display is applied to the transistors TP1 and TP2 as a potential of a substrate and a well region formed on the substrate. The transistors TP1 and TP2 have source terminals connected to the higher driving power-supply line V1L. A higher driving voltage V1 is applied to the transistors TP1 and TP2.

A ground potential of a lower power-source voltage used in the liquid crystal display is applied to the transistors TN1 and TN2 as a potential of the substrate and a well region formed on the substrate. The transistors TN1 and TN2 have source terminals connected to the lower driving power-supply line V0L. A lower driving voltage V0 is applied to the transistors TN1 and TN2.

Assuming that the higher and lower power-source voltages used in the liquid crystal display are represented as VDD and 0V, the higher driving voltage V1 and the lower driving voltage V0 have a relation represented by inequality (1).

$$VDD \geq V1 > V0 \geq 0 \quad (1)$$

A driving force of the first inverter INV1 is set to be larger than one of the second inverter INV2. Namely, the transistor TP1 is a transistor having a driving force larger than the transistor TP2, and the transistor TN1 is a transistor having a driving force larger than the transistor TN2.

The first transistor T1 is a transistor having a driving force larger than the transistor TN2. In order to smoothly and stably rewrite data held in the first hold unit 161 according to a logical value of sub-frame data, there is a difference between the driving forces of the first transistor T1 and the transistor TN2. Especially, it is useful when data with an L (low)-level (lower driving voltage V0) held in the output terminal OUT2 of the second inverter INV2 is rewritten to data with an H (high)-level (higher driving voltage V1).

In this case, a voltage VOUT2 of the output terminal OUT2 of the second inverter INV2 increases when an H-level (higher power-supply voltage VDD) is applied to the column data line d, which changes the first transistor T1 from a non-conductive state to a conductive state. A value of the voltage VOUT2 at time of the increase is determined depending on a ratio of electric current flowing in the transistor TN2 to electric current flowing in the first transistor T1. As the voltage VOUT2 increases to come close to a value (VDD-Vth), the electric current flowing in the first transistor T1 decreases. It is noted that Vth is a threshold value of the first transistor T1.

In this state, in order to invert the first inverter INV1 to rewrite data, it is necessary to increase the voltage VOUT2 to a voltage at which the first inverter INV1 is surely inverted. Thus, it is necessary to make the electric current flowing in the first transistor T1 larger than that flowing in the transistor TN2. Due to this, the first transistor T1 is the transistor having the driving force larger than the transistor TN2.

A hold operation for rewrite of sub-frame data in the first hold unit 161 will be described below. It is assumed that the H-level (higher driving voltage V1) is held in the output terminal OUT1 of the first inverter INV1, and the L-level (lower driving voltage V0) is held in the output terminal OUT2 of the second inverter INV2 in the first hold unit 161.

When the sub-frame data with the H-level (higher power-supply voltage VDD) is supplied to the column data line d so that the first transistor T1 is changed from the non-conductive state to the conductive state, the output voltage of the second inverter INV2 increases from the lower driving voltage V0. According to the increase of the output voltage of the second inverter INV2, the first inverter INV1 starts an invert operation so that the output voltage of the first inverter INV1 gradually decreases. In parallel with this, an invert operation of the second inverter INV2 proceeds so that the output voltage of the second inverter INV2 continues to increase.

The output voltage of the second inverter INV2 increases until it reaches the value (VDD-Vth). For example, if VDD is about 3.3V and Vth is about 0.6V, the output voltage of the second inverter INV2 increases until about 2.7V.

After the output voltage of the second inverter INV2 reaches the value (VDD-Vth), the first transistor T1 shifts to the non-conductive state. For example, if the higher driving voltage V1 is about 2.8V, the output voltage of the second inverter INV2 increases until the higher driving voltage V1 because it is lower than the higher driving voltage V1. In contrast, the output voltage of the first inverter INV1 decreases until the lower driving voltage V0.

Thereby, in the first hold unit 161, the invert operations of the first and second inverters INV1 and INV2 are completed and stabilized. As the result, the output voltage of the first inverter INV1 shifts from the H-level to the L-level, the output voltage of the second inverter INV2 shifts from the L-level to the H-level, and the respective outputs are held.

Next, when the sub-frame data with the L-level (lower power-supply voltage 0V) is supplied to the column data line d under this state so that the first transistor T1 is changed from the non-conductive state to the conductive state, the output voltage of the second inverter INV2 decreases from the higher driving voltage V1. According to the decrease of the output voltage of the second inverter INV2, the first inverter INV1 starts an invert operation so that the output voltage of the first inverter INV1 gradually increases. In parallel with this, an invert operation of the second inverter INV2 proceeds so that the output voltage of the second inverter INV2 continues to decrease.

At this time, if the lower driving voltage V0 is 0.5V, the output voltage of the second inverter INV2 is determined according to electric currents flowing through the first transistor T1, the transistor TP2 and the transistor TN2, and decreases until it reaches a voltage between the lower driving voltage V0 and 0V in the column date line d.

Then, when the first transistor T1 shifts to the non-conductive state, the output voltage of the second inverter INV2 increases until the lower driving voltage V0 because it is lower than the lower driving voltage V0. In contrast, the output voltage of the first inverter INV1 increases until the higher driving voltage V1.

Thereby, in the first hold unit 161, the invert operations of the first and second inverters INV1 and INV2 are completed and stabilized. As the result, the output voltage of the first inverter INV1 shifts from the L-level to the H-level, and the output voltage of the second inverter INV2 shifts from the H-level to the L-level.

Thus, the first hold unit 161 holds data associated with a logical value of the sub-frame data. The first hold unit 161 holds data with the same level as the sub-frame data in the output terminal OUT2 of the second inverter INV2. Namely, if the sub-frame data has the H-level (higher power-supply voltage VDD), data with the H-level (higher driving voltage V1) is held in the output terminal OUT2 of the second inverter INV2. In contrast, if the sub-frame data has the L-level (lower power-supply voltage 0V), data with the L-level (lower driving voltage V0) is held in the output terminal OUT2 of the second inverter INV2.

The first hold unit 161 holds data with the level opposite to that of the sub-frame data, in the output terminal OUT1 of the first inverter INV1. Namely, if the sub-frame data has the H-level (higher power-supply voltage VDD), data with the L-level (lower driving voltage V0) is held in the output terminal OUT1 of the first inverter INV1. In contrast, if the sub-frame data has the L-level (lower power-supply voltage 0V), data with the H-level (higher driving voltage V1) is held in the output terminal OUT1 of the first inverter INV1.

The first hold unit 161 outputs to the transfer control unit 162, the data with the level opposite to that of the sub-frame data, held in the output terminal OUT1 of the first inverter INV1. Namely, if the sub-frame data has the H-level (higher power-supply voltage VDD), the held data with the L-level (lower driving voltage V0) is output to the transfer control unit 162. In contrast, if the sub-frame data has the L-level (lower power-supply voltage 0V), the held data with the H-level (higher driving voltage V1) is output to the transfer control unit 162.

Thus, in the first hold unit 161, two pieces of data with both of the same level as the sub-frame data and the opposite level to the sub-frame data are held. Among the two pieces of held data with both levels, the data with the opposite level to the sub-frame data is output from the first hold unit 161. In view of this, in the following description, the term "hold data of the first hold unit 161" means data with the opposite level to the sub-frame data.

It is noted that in the present embodiment, although the first transistor T1 is the N-channel transistor, it may be a P-channel transistor instead of the N-channel transistor. In this case, logic of a row scanning signal to be supplied to the row scanning line g is opposite to the logic of the row scanning signal in the case where the N-channel transistor is used.

The transfer control unit 162 includes a second transistor T2 and the third transistor T3. The second transistor T2 is a MOS type P-channel transistor and the third transistor T3 is a MOS type N-channel transistor. The second and third transistors T2 and T3 have drain terminals commonly connected each other and source terminals commonly connected each other. Thereby, the transfer control unit 162 is configured as transmission gate.

The second transistor T2 has a gate terminal connected to the inverted trigger line "trigb". An inverted trigger pulse TRIB is supplied to the second transistor T2. The second transistor T2 is conductively controlled according to the inverted trigger pulse TRIB. The third transistor T3 has a gate terminal connected to the normal trigger line "trig". A normal trigger pulse TRI is supplied to the third transistor T3. The third transistor T3 is conductively controlled according to the normal trigger pulse TRI.

The second transistor T2 becomes a conductive state when the inverted trigger pulse TRIB has an L-level. The third transistor T3 becomes a conductive state when the normal trigger pulse TRI has an H-level. Thereby, the transfer control unit 162 transfers to the second hold unit 163, the data with a level opposite to the level of the sub-frame data held in the output terminal OUT1 of the first inverter INV1 in the first hold unit 161.

The transfer control unit 162 can surely transfer data held in the first hold unit 161 to the second hold unit 163 in low resistance without decreasing a voltage. Namely, the second transistor T2 becomes the conductive state when—the inverted trigger pulse TRIB of the inverted trigger line trigb is applied to the gate terminal thereof. The second transistor T2 is a P-channel transistor with a threshold voltage Vth of about 0.6V. Thereby, data with the H-level (higher driving voltage V1 of 2.8V) is transferred through the second transistor T2 without causing the decrease of voltage.

In contrast, the third transistor T3 becomes the conductive state when—the normal trigger pulse TR1 of the normal trigger line trig is applied to the gate terminal thereof. The third transistor T3 is an N-channel transistor with a threshold voltage Vth of about 0.6V. Thereby, data with the L-level (lower driving voltage V0 of 0.5V) is transferred through the third transistor T3 without causing the decrease of voltage.

The second hold unit 163 has a capacitor C1. The capacitor C1 has one end connected to an output side of the transfer control unit 162 and the other end connected to a ground potential. The second hold unit 163 holds as accumulated charge of the capacitor C1, the held data transferred from the first hold unit 161 through the transfer control unit 162.

If the level of data held in the first hold unit 161 differs from the level of data held in the second hold unit 163, the data held in the second hold unit 163 is rewritten as the data held in the first hold unit 161.

Charge or discharge of the capacitor C1 rewrites the data held in the second hold unit 163. The charge or discharge of the capacitor C1 is performed by the first inverter INV1.

When the data held in the capacitor C1 is rewritten from the L-level to the H-level by charge, the output voltage of the first inverter INV1 becomes the H-level. At this time, the transistor TP1 of the first inverter INV1 becomes the conductive state. Thereby, the higher driving voltage V1 is output from the first inverter INV1 to be applied to the capacitor C1 through the transfer control unit 162, which charges the capacitor C1 with the higher driving voltage V1.

In contrast, when the data held in the capacitor C1 is rewritten from the H-level to the L-level by discharge, the output voltage of the first inverter INV1 becomes the L-level. At this time, the transistor TN1 of the first inverter INV1 becomes the conductive state. Thereby, the accumulated charge corresponding to the higher driving voltage V1 of the capacitor C1 is discharged to a potential of the lower driving voltage V0 through the transfer control unit 162 and the transistor TN1.

As described above, the driving force of the first inverter INV1 is set to be larger than the driving force of the second inverter INV2. Thereby, the capacitor C1 of the second hold unit 163 is driven to be charged or discharged at high speed.

When the transfer control unit 162 becomes the conductive state, the second hold unit 163 is electrically connected to the input terminal IN2 of the second inverter INV2 of the first hold unit 161. Thereby, the accumulated charge of the capacitor C1 affects the input terminal IN2 of the second inverter INV2.

However, as described above, the driving force of the first inverter INV1 is set to be larger than the driving force of the second inverter INV2. Thereby, the charge or discharge of the capacitor C1 by the first inverter INV1 overrides the invert operation of the second inverter INV2 due to the accumulated charge of the capacitor C1. As the result, when the data held in the second hold unit 163 is rewritten, the data held in the first hold unit 161 is not rewritten.

The pixel unit 164 performs gradation display according to the data held in the second hold unit 163 by each sub-frame. The pixel unit 164 includes a reflective electrode PE connected to one end side of the transfer control unit 162 and the capacitor C1, a common electrode CE arranged to be opposite to and away from the reflective electrode PE, and a liquid crystal LCM. The liquid crystal LCM is filled and sealed between the reflective electrode PE and the common electrode CE.

In the above-described configuration of the pixel circuit 16, it is supposed that another configuration with a capacitor will be employed instead of the self-holding storage circuit composed of the first inverter INV1 and the second inverter INV2 of the first hold unit 161. In a case of employing this configuration, when the capacitor of the first hold unit 161 and the capacitor C1 of the second hold unit 163 are electrically connected with each other, neutralization of charge accumulated in both capacitors occurs. Due to this, in voltage supplied to the pixel unit 164, switching between the lower driving voltage V0 and the higher driving voltage V1 can not be obtained.

In contrast, in the configuration of the present embodiment, the data held in the first hold unit 161 can be transferred to the second hold unit 163 with the switching between the lower driving voltage V0 and the higher driving voltage V1. Due to this, when the pixel unit 164 is driven by the lower driving voltage V0 and the higher driving voltage V1, a voltage to be applied to the liquid crystal LCM can be set higher than another configuration. As the result, the configuration of the present embodiment can extend a dynamic range of liquid crystal display.

Also, it is supposed that another configuration with a capacitor instead of the first and second inverters INV1 and INV2 and with the self-holding storage circuit used in the first hold unit 161 instead of the capacitor C1 in the second hold unit 163, is employed.

In this case, operation becomes unstable in comparison with the operation under the configuration of the present invention. Namely, in the above-described another configuration, it is necessary to rewrite data held in the self-holding storage circuit in the second hold unit 163 with charge accumulated in the capacitor in the first hold unit 161.

The data holding capacity of self-holding storage circuit is generally higher than the charge holding capacity of capacitor. Due to this, when the capacitor in the first hold unit 161 are electrically connected to the self-holding storage circuit in the second hold unit 163, there is a possibility that the charge accumulated in the capacitor is rewritten by the data held in the self-holding storage circuit.

In order to prevent the charge accumulated in the capacitor from being rewritten by the data held in the self-holding storage circuit, it is necessary to enlarge capacitance of the capacitor. This enlarges the size of the pixel circuit 16, which inhibits the realization of downsized pixel circuit 16.

On the other hand, the pixel circuit 16 in the present embodiment can apply to the liquid crystal LCM, a driving voltage which is the higher driving voltage V1 or the lower driving voltage V0 arbitrarily set between the higher power-supply voltage VDD and the ground potential of the lower power-supply voltage 0V. Thereby, it is possible to supply an applied voltage suitable for a display color of liquid crystal display, which extends a dynamic range of liquid crystal display.

The pixel circuit 16 in the present embodiment is formed by seven transistors and one capacitor. In addition, the first hold unit 161, the second hold unit 163 and the reflective electrode PE are arranged in a height direction of element, which will be described below. This ensures stable operation and realizes a downsized configuration.

Figure 3:
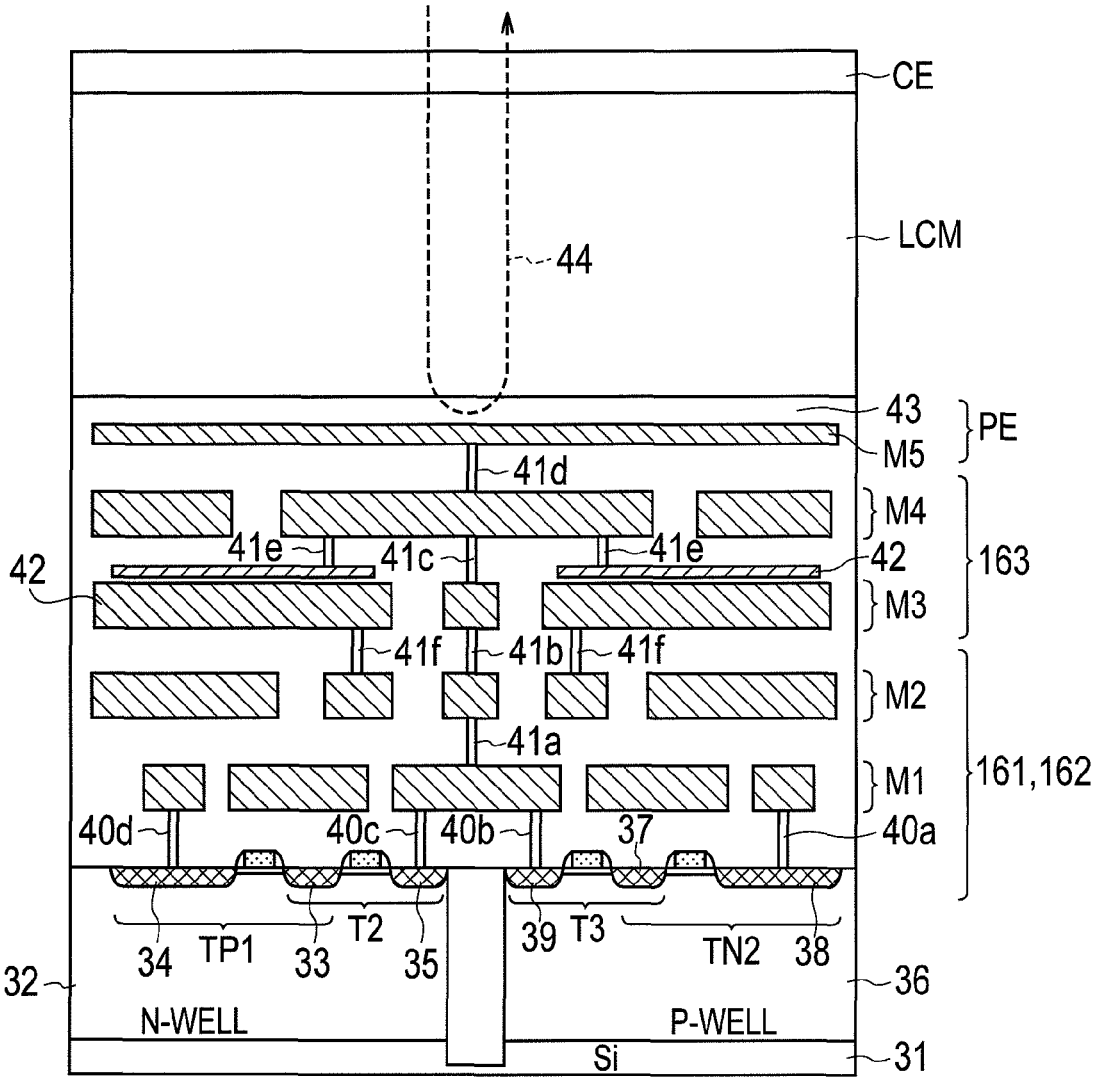
FIG. 3 is a schematic diagram that illustrates a cross-sectional surface of a laminated structure in the pixel circuit according to the first exemplary embodiment of the present invention.

The pixel circuit 16 shown in FIG. 2 has a metal wiring structure with five layers (first to fifth metal wiring layers M1 to M5) shown in FIG. 3, for example.

In FIG. 3, a first diffuse layer 33 is formed on an n-well 32 formed on a silicon substrate 31. The transistor TP1 of the first inverter INV1 and the second transistor T2 of the transfer control unit 162 whose the drain terminals are connected with each other, are formed by commonly using the first diffuse layer 33. A second diffuse layer 34 to be used as the source of the transistor TP1 of the first inverter INV1, is formed on the n-well 32. A third diffuse layer 35 to be used as the source of the second transistor T2 of the transfer control unit 162, is formed on the n-well 32.

A fourth diffuse layer 37 is formed on a p-well 36 formed on the silicon substrate 31. The transistor TN2 of the second inverter INV2 and the third transistor T3 of the transfer control unit 162 whose the drain terminals are connected with each other, are formed by commonly using the fourth diffuse layer 37. A fifth diffuse layer 38 to be used as the source of the transistor TN2 of the second inverter INV2, is formed on the p-well 36. A sixth diffuse layer 39 to be used as the source of the third transistor T3 of the transfer control unit 162, is formed on the p-well 36.

It is noted that the transistor TN1 of the first inverter INV1 and the transistor TP2 of the second inverter INV2 are not shown in FIG. 3.

The first metal wiring layers M1 to M5 are stacked via interlayer insulating films (not shown) above each of the transistors TP1, TN2, T2 and T3.

The fifth diffuse layer 38 to be used as the source of the transistor TN2 is connected to a first wiring portion of the first metal wiring layer M1 via a contact 40*a*. The diffuse layer 39 to be used as the source of the third transistor T3 is connected to a second wiring portion of the first metal wiring layer M1 via a contact 40*b*.

The diffuse layer 35 to be used as the source of the second transistor T2 is connected to a third wiring portion of the first metal wiring layer M1 which is connected to the diffuse layer 39, via a contact 40*c*. The diffuse layer 34 to be used as the source of the transistor TP1 is connected to a fourth wiring portion of the first metal wiring layer M1 via a contact 40*d*. A fifth wiring portion of the first metal wiring layer M1 connected to the third and sixth diffuse layers 35 and 39 is connected to a first wiring portion of the second metal wiring layer M2 via a through hole 41*a*.

A second wiring portion of the second metal wiring layer M2 is connected to a first wiring portion of the third metal wiring layer M3 via a through hole 41*b*. A second wiring portion of the third metal wiring layer M3 is connected to a first wiring portion of the fourth metal wiring layer M4 via a through hole 41*c*. A second wiring portion of the fourth metal wiring layer M4 is connected to a first wiring portion of the fifth metal wiring layer M5 via a through hole 41*d*.

The certain wiring portion of the fifth metal wiring layer M5 is used as the reflective electrode PE. Thereby, the sources of the second transistor T2 and the third transistor T3 are connected to the reflective electrode PE at the first wiring portion of the fifth metal wiring layer M5 via the wiring portions of the first to fourth metal wiring layers M1 to M4.

The wiring portions of the first and second metal wiring layers M1 and M2 form wirings in the first hold unit 161 and the transfer control unit 162.

An MIM (Metal-Insulator-Metal) electrode 42 is formed on a third wiring portion of the third metal wiring layer M3 via an interlayer insulating film (not shown). The MIM electrode 42, the third wiring portion of the third metal wiring layer M3 and the interlayer insulating film constitute the capacitor C1.

The MIM electrode 42 is connected to a third wiring portion of the fourth metal wiring layer M4 via a through hole 41*e*. The second wiring portion of the fourth metal wiring layer M4 is connected to the reflective electrode PE via the through hole 41*d*. A fourth certain wiring portion of the third metal wiring layer M3 is connected to a third certain wiring portion of the second metal wiring layer M2 via a through hole 41*f*. The third certain wiring portion of the second metal wiring layer M2 is grounded. Thereby, the capacitor C1 is connected to the reflective electrode PE at one end thereof and is grounded at the other end thereof.

The wiring portions of the third and fourth metal wiring layers M3 and M4 form wiring in the second hold unit 163.

As a protective film, a passivation film (PSV) 43 is formed on a second wiring portion of the fifth metal wiring layer M5 constituting the reflective electrode PE. The common electrode CE which is a transparent electrode is arranged on the passivation film 43 through the liquid crystal LCM such that the common electrode CE is opposed to and away from the passitvation film 43. Thereby, the liquid crystal LCM is filled and sealed between the reflective electrode PE and the common electrode CE, which forms the pixel unit 164.

It is noted that the capacitor C1 may be a diffusion capacitor, a PIP (Poly-Insulator-Poly) capacitor or the like, instead of an MIM capacitor which forms capacitance between the above-described wirings which are opposed to each other through the interlayer insulating film. The diffusion capacitor forms capacitance between a substrate and a poly-silicon which are opposed to each other through an insulating film. The PIP capacitor forms capacitance between two pieces of poly-silicon which are opposed to each other through an insulating film.

When light is emitted from a light source (not shown) to the pixel circuit 16 having the above-described multi-layers wiring structure, the light enters the reflective electrode PE through the common electrode CE and the liquid crystal LCM. As shown in FIG. 3, the light having entered the reflective electrode PE returns in an incident path 44 and then passes through the common electrode CE to exit the pixel unit 164.

In the pixel circuit 16 having the above-described multi-layers wiring structure, the wiring portion of the fifth metal wiring layer M5 which is the uppermost layer, is used as the reflective electrode PE. Thereby, the first hold unit 161, the transfer control unit 162, the second hold unit 163 and the reflective electrode PE can be arranged in the height direction. This increases a degree of integration of the pixel circuit 16 in a planar direction, which realizes a downsized configuration.

For example, the pixel circuit 16 with a pitch of 3 μm or less can be realized by a transistor with the higher driving voltage V1 of about 3.3V. In the pixel circuit 16 with a pitch of 3 μm or less than, a liquid crystal display panel with 4000 pixels in a horizontal direction and 2000 pixels in a vertical direction having the length of diagonal line of 0.55 inches can be realized.

Next, writing and reading operations of sub-frame data in the present embodiment will be described, with reference to a timing chart of FIG. 4.

In the liquid crystal display shown in FIG. 1, a row scanning line is sequentially selected by 1H unit one by one from the row scanning line g1 toward the row scanning line gm, according to a row scanning signal from the vertical shift register 13. Thereby, in the plurality of pixel circuits 16 forming the display unit 11, writing of n-pieces of sub-frame data is performed in n-pixel circuits 16 on one row commonly connected to the selected row scanning line. After writing is completed in all pixel circuits 16 forming the display unit 11, reading is performed in all pixel circuits 16 all at once according to the normal trigger pulse TRI and the inverted trigger pulse TRIB.

FIG. 4(X) shows a case where the lower power-supply voltage GND=0V, the higher power-supply voltage VDD=3.3V, the lower driving voltage V0=0.5V and the higher driving voltage V1=2.8V in the following timing chart.

In such a potential relationship, the higher and lower power-supply voltages of the transistor other than those in the first hold unit 161 are 3.3V and 0V, respectively. The signal amplitude of sub-frame data is 3.3V. The amplitude between the higher driving voltage V1 and the lower driving voltage V0 is 2.3V. Therefore, the amplitude of each of pieces of data held in the first and second hold units 161 and 163 is 2.3V. It is noted that the term "amplitude" indicates that the absolute value of difference between higher and lower voltages.

FIG. 4(A) schematically shows a writing period and a reading period in one pixel circuit 16 for sub-frame data having 1-bit value to be output from the horizontal driver 15 to each of the column data lines d1 to dn. A diagonal line which is diagonally right down in FIG. 4(A) indicates the writing period.

It is noted that logics of bits B0*b*, B1*b* and B2*b* in inverted sub-frame data are opposite to logics of bits B0, B1 and B2 in normal sub-frame data. The normal sub-frame data with the bit B0 and the inverted sub-frame data with the bit B0*b* constitute one sub-frame (first sub-frame). In the first sub-frame, the first half which is a period between times T1 and T2 corresponds to the reading period for the bit B0. The last half which is a period between times T2 to T3 corresponds to the reading period for the bit B0*b*. The first half of the first sub-frame is set to have the same period as the last half of the first sub-frame.

The normal sub-frame data with the bit B1 and the inverted sub-frame data with the bit B1*b* constitute one sub-frame (second sub-frame). In the second sub-frame, the first half which is a period between times T3 and T4 corresponds to the reading period for the bit B1. The last half which is a period between times T4 to T5 corresponds to the reading period for the bit B1*b*. The first half of the second sub-frame is set to have the same period as the last half of the second sub-frame.

The normal sub-frame data with the bit B2 and the inverted sub-frame data with the bit B2*b* constitute one sub-frame (third sub-frame). In the third sub-frame, the first half which is a period between times T5 and T6 corresponds to the reading period for the bit B2. The last half which is a period between times T6 to T7 corresponds to the reading period for the bit B2*b*. The first half of the third sub-frame is set to have the same period as the last half of the third sub-frame.

Figure 4:
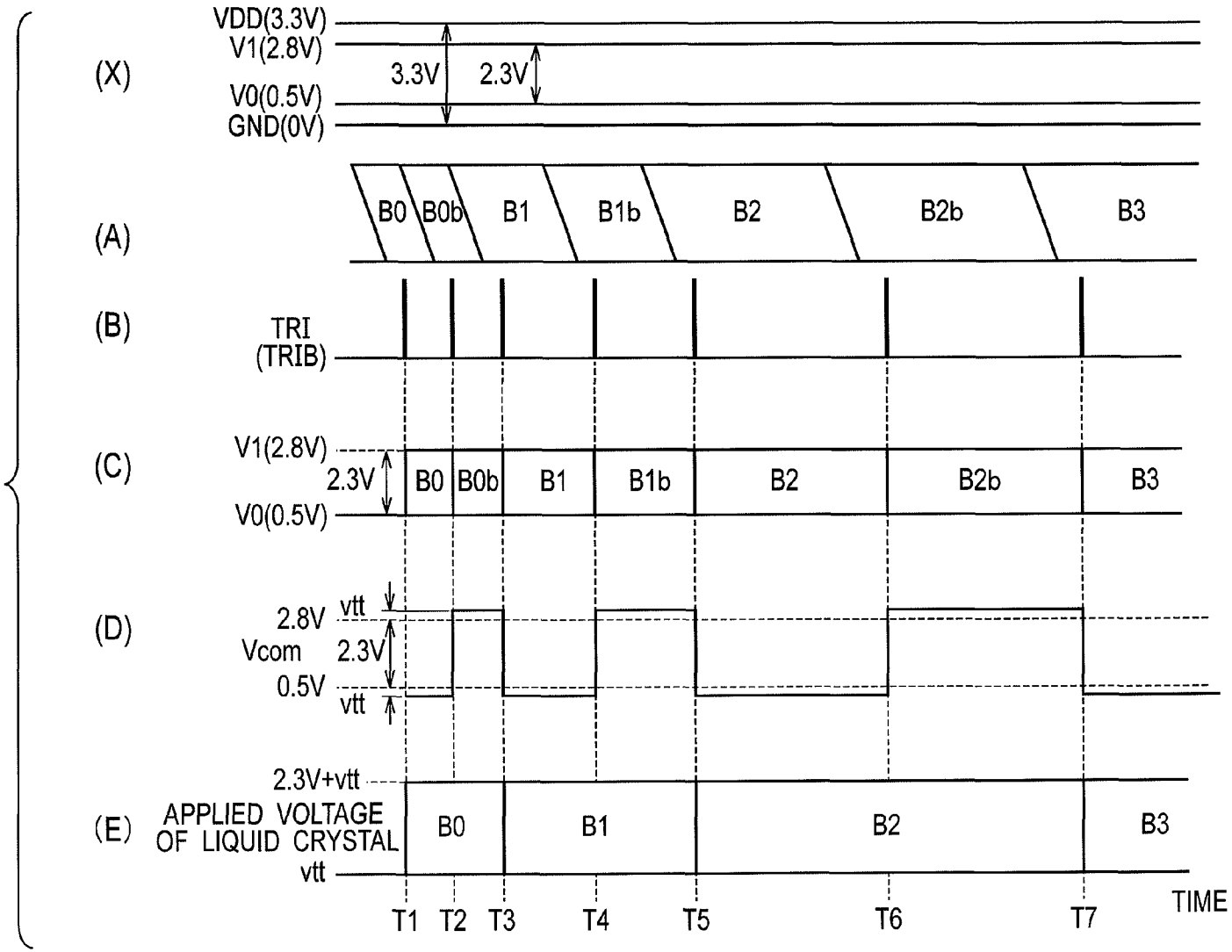
FIG. 4 is a timing chart that illustrates one example of a driving method of the liquid crystal display according to the first exemplary embodiment of the present invention.

In FIG. 4, the period (times T5 to T7) of the third sub-frame is set to have twice the length of the period (times T3 to T5) of the second sub-frame. The period (times T3 to T5) of the second sub-frame is set to have twice the length of the period (times T1 to T3) of the first sub-frame. It is noted that each of the periods of the first to third sub-frames is not limited to the above, and may be arbitrarily set.

Although three sub-frames which are the first to third sub-frames are described in FIG. 4, the number of sub-frames may be arbitrarily set. One frame is composed of sub-frames whose the number is arbitrarily set.

FIG. 4(B) shows output timings of the normal trigger pulse TRI output from the timing generator 12 to the normal trigger line "trig", and the inverted trigger pulse TRIB output from the timing generator 12 to the inverted trigger line "trigb". These trigger pulses are output by one sub-frame unit. It is noted that a logical value of the normal trigger pulse TRI is always opposite to one of the inverted trigger pulse TRIB.

In respective pixel circuits 16 on one row selected by the row scanning signal, the normal sub-frame data with the bit B0 shown in FIG. 4(A) to be output to the column data line d is written in the first hold unit 161 through the first transistor T1.

At this time, the signal amplitude of sub-frame data having 1-bit value to be output to each of the column data lines d1 to do is 3.3V. The signal amplitude of row scanning signal is also 3.3V. Thereby, sub-frame data with the L-level being 0V or the H-level being (3.3V-Vth) is input to the first hold unit 161. It is noted that Vth is a threshold voltage of transistor employed in the pixel circuit 16, and has a value about 0.6V for example.

For example, when sub-frame data with the H-level is output to the column data line d, the voltage VOUT2 of the output terminal OUT2 of the second inverter INV2 has a value about 2.7V which is (3.3V-Vth). Since the voltage VOUT2 is a gate voltage of the transistor TP1, the voltage having the value about 2.7V is applied to the gate terminal of the transistor TP1. This indicates that the transistor TP1 does not completely become a conductive state.

In contrast, since the voltage VOUT2 having the value about 2.7V is considerably higher than the lower driving voltage V0, the transistor TN1 becomes a conductive state. This indicates that a voltage closer to 0V which is determined depending on a ratio of electric current flowing in the transistor TP1 to electric current flowing in the transistor TN1, is applied to gate terminals of the transistor TP2 and the transistor TN2. In this state, although a slight electric current flows through the first inverter INV1 and the second inverter INV2, the self-holding storage function normally works.

Then, when the first transistor T1 becomes a non-conductive state, the voltage VOUT2 shifts to the higher driving voltage V1 of 2.8V and the voltage VOUT1 shifts to the lower driving voltage V0 of 0.5V. This indicates that the first hold unit 161 holds data corresponding to sub-frame data with the amplitude of 2.3V which is switched between 0.5V and 2.8V.

The above-described work is performed in all pixel circuits 16 constituting the display unit 11, and writing of data corresponding to the normal sub-frame data with the bit B0 is performed in the first hold unit 161. This writing operation is performed before time T1 shown in FIG. 4.

Then, at time T1 shown in FIG. 4, the normal trigger pulse TRI with the H-level and the inverted trigger pulse TRIB with the L-level are simultaneously supplied to all pixel circuits 16 constituting the display unit 11 as shown in FIG. 4(B). Thereby, since all transfer control units 162 are conducted, all pieces of data held in the first hold units 161 are transferred to the second hold units 163 through the transfer control units 162 and then are held in the capacitors C1 included in the second hold units 163. All pieces of data held in the capacitors C1 are applied to the reflective electrodes PE of the pixel units 64.

Since the capacitor C1 of the second hold unit 163 can hold an analog voltage value, the capacitor C1 can hold the higher driving voltage V1 or the lower driving voltage V0 which is arbitrarily selected within a range between the lower power-supply voltage and the higher power-supply voltage.

Data to be held in the second hold unit 163 is the data held in the output terminal OUT1 of the first inverter INV1 of the first hold unit 161. A level of this data is the level which is obtained by inverting the level of sub-frame data output to the column data line d. Namely, when the sub-frame data has the L-level (0V), the data to be held in the second hold unit 163 has the H-level (2.8V). In contrast, when the sub-frame data has the H-level (3.3V), the data to be held in the second hold unit 163 has the L-level (0.5V).

A holding period of the data held in the second hold unit 163 is a period from time T1 to time T2 when a next normal trigger pulse TRI and a next inverted trigger pulse TRIB are input, shown in FIG. 4. That is, the holding period corresponds to a period of the first half of the first sub-frame.

FIG. 4(C) schematically shows a bit of data to be applied to the reflective electrode PE.

When a bit value of sub-frame data is 0, that is the sub-frame data has the L-level, the higher driving voltage V1 of 2.8V is applied to the reflective electrode PE. In contrast, when a bit value of sub-frame data is 1, that is the sub-frame data has the H-level, the lower driving voltage V0 of 0.5V is applied to the reflective electrode PE.

The common electrode voltage Vcom which is previously set depending on a voltage to be applied to the reflective electrode PE, is applied to the common electrode CE. When the normal trigger pulse TRI and the inverted trigger pulse TRIB are output, the common electrode voltage Vcom is switched to a regular voltage value at the same time.

In a period between time T1 to time T2 of the first half of the first sub-frame, the common electrode voltage Vcom has the regular voltage value shown in FIG. 4(D). The regular voltage value is set to the voltage of (0.5−Vtt) which is lower than the lower driving voltage V0 of 0.5V by a threshold voltage Vtt of the liquid crystal LCM.

Thereby, an applied voltage of the liquid crystal LCM becomes a voltage of (2.3+Vtt) (=2.8−(0.5−Vtt)) when a bit value of the normal sub-frame data is 0 in the period between time T1 and time T2. In contrast, when a bit value of the normal sub-frame data is 1, an applied voltage of the liquid crystal LCM becomes a voltage of Vtt (=0.5−(0.5−Vtt)). Therefore, the absolute value of the applied voltage of the liquid crystal LCM has a value shown in FIG. 4(E).

Figure 5:
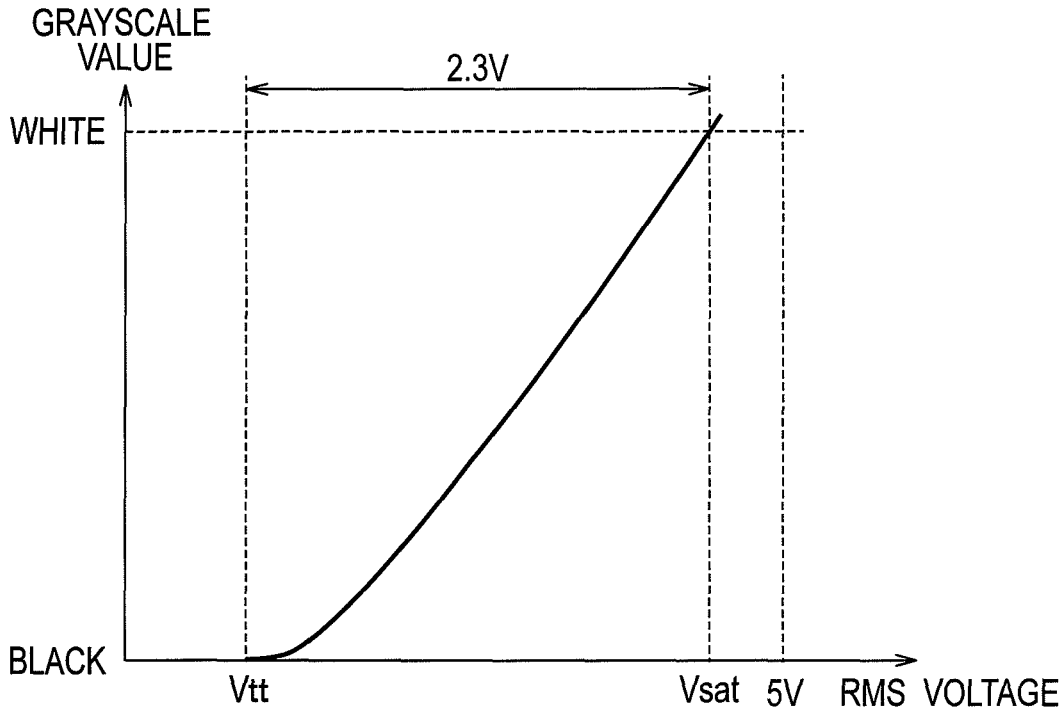
FIG. 5 is a diagram that illustrates a relation between an applied voltage (RMS voltage) of a liquid crystal and a grayscale value.

FIG. 5 shows a relation between the applied voltage (RMS (root mean square value) voltage) of the liquid crystal LCM and a grayscale value of the liquid crystal LCM. In FIG. 5, a characteristic curve shifts a grayscale value such that the grayscale value of black color corresponds to RMS voltage which is the threshold voltage Vtt of the liquid crystal LCM and the grayscale value of white color corresponds to RMS voltage which is a saturated voltage Vsat (=2.3+Vtt) of the liquid crystal LCM. It is possible to match the grayscale value to an effective portion of a liquid crystal response curve. Therefore, the pixel unit 164 displays white color at the time when the applied voltage of the liquid crystal LCM has a value of (2.3+Vtt), and displays black color at the time when the applied voltage of the liquid crystal LCM has a value of +Vtt.

Returning to FIG. 4, an operation for writing in the first hold unit 161, sub-frame data with the bit B0*b* into which the bit B0 is inverted, is performed within the period of the first half of the first sub-frame. The operation for writing this inverted sub-frame data with the bits B0*b* is performed as well as the operation for writing the normal sub-frame data with the bit B0.

Then, at time T2 shown in FIG. 4, the normal trigger pulse TRI with the H-level and the inverted trigger pulse TRIB with the L-level are simultaneously supplied to all pixel circuits 16 constituting the display unit 11 as shown in FIG. 4(B). Thereby, since all transfer control units 162 are conducted, all pieces of data held in the first hold units 161 are transferred to the second hold units 163 through the transfer control units 162, and then are held in the capacitors C1 included in the second hold units 163. All pieces of data held in the capacitors C1 are applied to the reflective electrodes PE of the pixel units 164.

A holding period of the data held in the second hold unit 163 is the period from time T2 to time T3 when a next normal trigger pulse TRI and a next inverted trigger pulse TRIB are input, shown in FIG. 4. That is, the holding period corresponds to the period of the last half of the first sub-frame. When a bit value of sub-frame data is 0, that is the sub-frame data has the L-level, the higher driving voltage V1 of 2.8V is applied to the reflective electrode PE. In contrast, when a bit value of sub-frame data is 1, that is the sub-frame data has the H-level, the lower driving voltage V0 of 0.5V is applied to the reflective electrode PE.

In the period between time T2 to time T3 of the last half of the first sub-frame, the common electrode voltage Vcom has the regular voltage value shown in FIG. 4(D). The regular voltage value is set to a voltage of (2.8+Vtt) which is higher than the higher driving voltage V1 of 2.8V by the threshold voltage Vtt of the liquid crystal LCM.

Thereby, an applied voltage of the liquid crystal LCM becomes the voltage of −Vtt(=2.8−(2.8+Vtt)) when a bit value of the normal sub-frame data is 0 in the period of the last half of the firs sub-frame. In contrast, when a bit value of the normal sub-frame data is 1, an applied voltage of the liquid crystal LCM becomes the voltage of −(2.3+Vtt) (=0.5−(2.8+Vtt)). Therefore, the absolute value of the applied voltage of the liquid crystal LCM has a value shown in FIG. 4(E).

In the period between time T1 and time T2 of the first half of the first sub-frame, when the bit value of the normal sub-frame data with the bit B0 is 0, an applied voltage of the liquid crystal LCM becomes the voltage of (2.3+Vtt). In the period between time T2 and time T3 of the last half subsequent to the first half of the first sub-frame, a logical value of the inverted sub-frame data with the bit B0*b* is 1 which is opposite to the logical value of the normal sub-frame data with the bit B0. Therefore, an applied voltage of the liquid crystal LCM becomes the voltage of −(2.3+Vtt) in the period of the last half of the first sub-frame.

Thereby, the direction of potential applied to the liquid crystal LCM in the first half of the first sub-frame is opposite to the direction of potential applied to the liquid crystal LCM in the last half of the first sub-frame, and the absolute value of applied voltage in the first half of the first sub-frame is equal to the absolute value of applied voltage in the last half of the first sub-frame. Therefore, the pixel circuit 16 displays white color in the first half and the last half of the first sub-frame as shown in the grayscale value of FIG. 5.

In contrast, in the period between time T1 and time T2 of the first half of the first sub-frame, when the bit value of the normal sub-frame data with the bit B0 is 1, an applied voltage of the liquid crystal LCM becomes the voltage of +Vtt. In the period between time T2 and time T3 of the last half subsequent to the first half of the first sub-frame, a logical value of the inverted sub-frame data with the bit B0*b* is 0 which is opposite to the logical value of the normal sub-frame data with the bit B0. Therefore, an applied voltage of the liquid crystal LCM becomes the voltage of −Vtt in the period of the last half of the first sub-frame.

Thereby, the direction of potential applied to the liquid crystal LCM in the first half of the first sub-frame is opposite to the direction of potential applied to the liquid crystal LCM in the last half of the first sub-frame, and the absolute value of applied voltage in the first half of the first sub-frame is equal to the absolute value of applied voltage in the last half of the first sub-frame. Therefore, the pixel circuit 16 displays black color in the first half and the last half of the first sub-frame as shown in the grayscale value of FIG. 5.

As described above, although the bit value of the first sub-frame in the first half of the first sub-frame is opposite to that in the last half of the first sub-frame, display is performed with the same gradation in the first half and the last half of the first sub-frame. Further, the potential direction of the applied voltage of the liquid crystal LCM is inverted between the first half and the last half of the first sub-frame, which AC-drives the liquid crystal LCM. This prevents the liquid crystal LCM from being burned in.

Within the period between time T2 and time T3 of the last half of the first sub-frame, an operation for writing the normal sub-frame data with the bit B1 is performed, in parallel to reading of the inverted sub-frame data with the bits B0*b*. This writing operation is performed as well as the operation for writing the normal sub-frame data with the bit B0.

When the operation for writing the normal sub-frame data with the bit B0 is completed, an operation for reading the normal sub-frame data with the bit B1 is performed within the period between time T3 and time T4 of the first half of the second sub-frame. This reading operation is performed as well as the operation for reading the normal sub-frame data with the bit B0. Also, in parallel to this reading operation, an operation for writing the inverted sub-frame data with the bit B1*b* is performed. This writing operation is performed as well as the operation for writing the inverted sub-frame data with the bit B0*b*.

When the operation for writing the inverted sub-frame data with the bit B1*b* is completed, an operation for reading the inverted sub-frame data with the bit B1*b* is performed within the period between time T4 and time T5 of the last half of the second sub-frame. This reading operation is performed as well as the operation for reading the inverted sub-frame data with the bit B0*b*.

Therefore, while the length of period for reading the second sub-frame differs from the length of period for reading the first sub-frame, the applied voltage method of the liquid crystal LCM in the second sub-frame is the same as the first sub-frame. Thereby, in the second sub-frame, display is performed according to sub-frame data, as well as the first sub-frame.

Within the period between time T4 and time T5 of the last half of the second sub-frame, in parallel to reading of the inverted sub-frame data with the bit B1*b*, an operation for writing the normal sub-frame data with the bit B2 is performed. This writing operation is performed as well as the operation for writing the normal sub-frame data with the bit B0.

When the operation for writing the normal sub-frame data with the bit B2 is completed, an operation for reading the normal sub-frame data with the bit B2 is performed within the period between time T5 and time T6 of the first half of the third sub-frame. This reading operation is performed as well as the operation for reading the normal sub-frame data with the bit B0. Also, in parallel to this reading operation, an operation for writing the inverted sub-frame data with the bit B2*b* is performed. This writing operation is performed as well as the operation for writing the inverted sub-frame data with the bit B0*b*.

When the operation for writing the inverted sub-frame data with the bit B2*b* is completed, an operation for reading the inverted sub-frame data with the bit B2*b* is performed within the period between time T6 and time T7 of the last half of the second sub-frame. This reading operation is performed as well as the operation for reading the inverted sub-frame data with the bit B0*b*.

Therefore, while the length of period for reading the third sub-frame differs from the length of period for reading the first sub-frame, the applied voltage method of the liquid crystal LCM in the third sub-frame is the same as the first sub-frame. Thereby, in the third sub-frame, display is performed according to sub-frame data, as well as the first and second sub-frames.

As described above, the liquid crystal display in the present embodiment can display an image of one frame composed of plural sub-frames, depending on a combination of plural pieces of sub-frame according to a gradation at a time of displaying the image.

Figure 6:
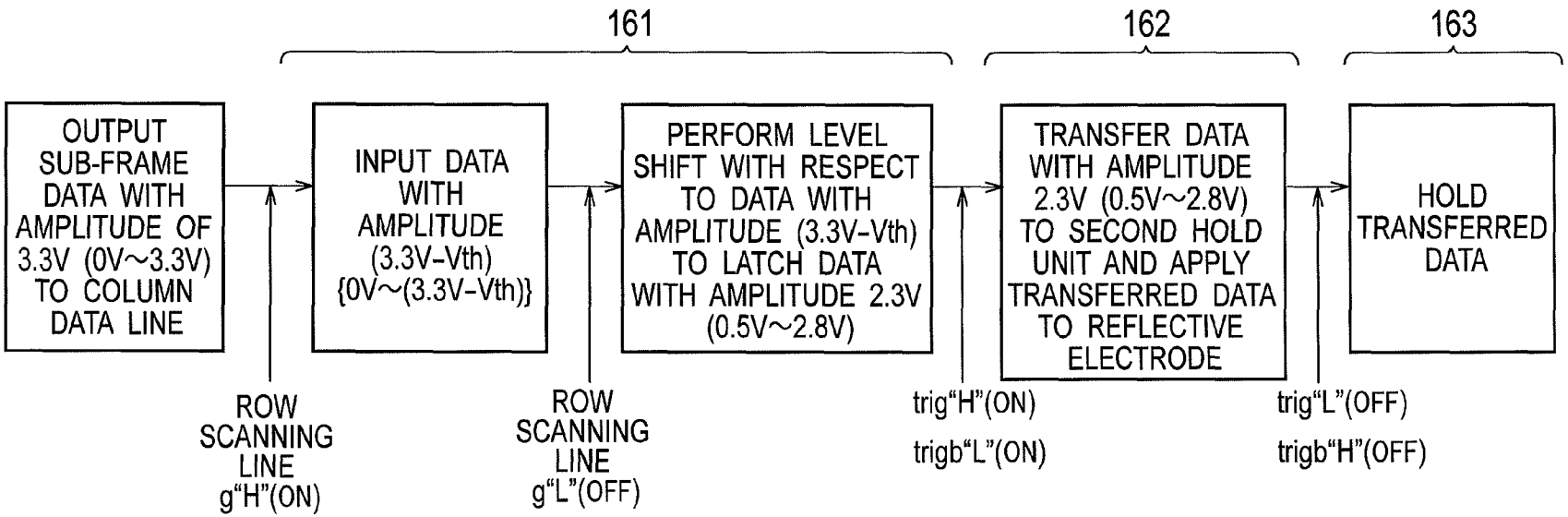
FIG. 6 is a diagram that illustrates an operation flow in the pixel circuit according to the first exemplary embodiment of the present invention.

Next, an operation flow of the pixel circuit 16 will be described with reference to FIG. 6.

When sub-frame data is supplied to the column data line d with the amplitude of 3.3V (0V to 3.3V), the row scanning line g is changed to the H-level, which changes the first transistor T1 into the conductive state (On). Thereby, sub-frame data with the amplitude of 2.7V (=3.3V−Vth) (0V to (3.3V−Vth)) is input to the first hold unit 161. Subsequently, the row scanning line g is changed to the L-level, which changes the first transistor T1 into the non-conductive state (Off). Thereby, the first hold unit 161 performs a level shift with respect to the input sub-frame with the amplitude of 2.7V. As the result, the first hold unit 161 latches the sub-frame data with the amplitude of 2.3V (0.5V to 2.8V) and holds it.

After the sub-frame data is held, the normal trigger line "trig" and the inverted trigger line "trigb" are respectively changed to the H-level and the L-level, which changes the transfer control unit 162 into the conductive state (On). Thereby, data with the L-level of the lower driving voltage V0 (=0.5V) or the H-level of the higher driving voltage V1 (=2.8V) in the amplitude of 2.3V is transferred to the second hold unit 163 through the transfer control unit 162. The data transferred to the second hold unit 163 is applied to the reflective electrode PE of the pixel unit 164.

Then, the normal trigger line "trig" and the inverted trigger line "trigb" are respectively changed to the L-level and the H-level, which changes the transfer control unit 162 into the non-conductive state (Off). Thereby, the second hold unit 163 holds the transferred data. The second hold unit 163 applies the held data to the reflective electrode PE of the pixel unit 164.

While the higher driving voltage V1 is set to an arbitrary value within the range represented by the inequality (1), the lower driving voltage V0 may be set to the ground potential. In this case, a voltage to be applied to the liquid crystal LCM is changed between 0V and V1. Thereby, there are three types of power-supply wirings which are the higher power-supply voltage VDD, the lower power-supply voltage (ground potential) and the higher driving voltage V1.

As the result, it is possible to reduce the number of power-supply wirings, in comparison with a case where the lower driving voltage V0 is set to an arbitrary value other than the ground potential. Therefore, it is possible to shorten intervals at which the pixel circuits 16 are arranged, which downsizes the display unit 11. Downsizing the display unit 11 shortens the wiring length, which prevents a signal delay. In addition, in a case where the display unit 11 is formed with the same area as the case where the lower driving voltage V0 is set to an arbitrary value other than the ground potential, it is possible to increase the number of the pixel circuits 16 to be formed, which realizes a large number of pixels.

As well, while the lower driving voltage V0 is set to an arbitrary value within the range represented by the inequality (1), the higher driving voltage V1 may be set to the higher power-source voltage VDD. In this case, a voltage to be applied to the liquid crystal LCM is changed between V0 and VDD.

Thereby, there are three types of power-supply wirings which are the higher power-supply voltage VDD, the lower power-supply voltage (ground potential) and the lower driving voltage V0. As the result, it is possible to obtain the effect similar to the case where the lower driving voltage V0 is set to the ground potential.

Figure 7:
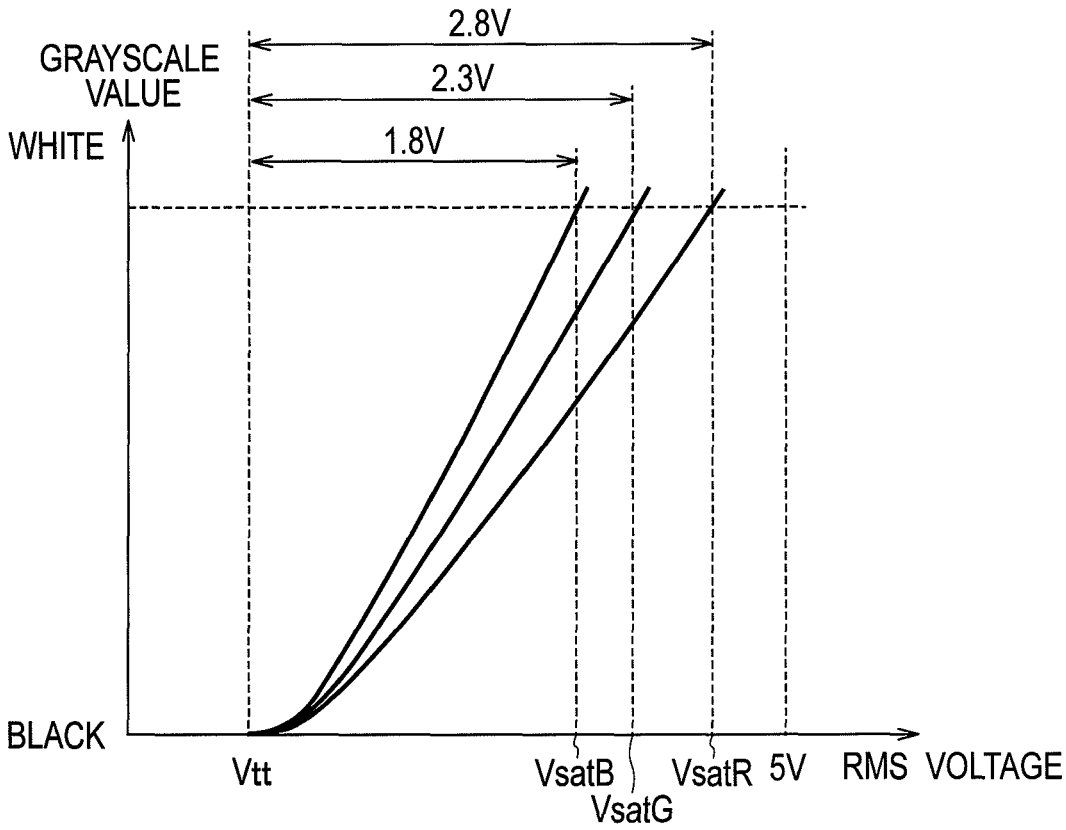
FIG. 7 is a diagram that illustrates a relation between an applied voltage (RMS voltage) of a liquid crystal and a grayscale value in each of three primary colors RGB.

A relation between an applied voltage (RMS voltage) of the liquid crystal LCM and a grayscale value of the liquid crystal LCM in each of three primary colors RGB will be described with reference to FIG. 7. As shown in FIG. 7, a characteristic curve shifts a grayscale value such that the grayscale value of black color corresponds to RMS voltage which is the threshold voltage Vtt of the liquid crystal LCM and the grayscale value of white color corresponds to RMS voltage which is a saturated voltage of the liquid crystal LCM.

In a liquid crystal projector, there is a three plate method in which a liquid crystal display with three panels corresponding to three primary colors RGB is employed. In this method, saturate voltages of the liquid crystal LCM for respective colors which are R (red color), G (green color) and B (blue color), differ from one other. The saturate voltage VsatR of the liquid crystal LCM for R has the highest value. The saturate VsatG of the liquid crystal LCM for G has a middle value. The saturate value VsatB of the liquid crystal LCM for B has the lowest value.

In the liquid crystal LCM for R, the characteristic curve shifts a grayscale value such that the grayscale value of white color corresponds to RMS voltage which is a saturated voltage VsatR (=2.8V+Vtt). In the liquid crystal LCM for G, the characteristic curve shifts a grayscale value such that the grayscale value of white color corresponds to RMS voltage which is a saturated voltage VsatG (=2.3V+Vtt). In the liquid crystal LCM for B, the characteristic curve shifts a grayscale value such that the grayscale value of white color corresponds to RMS voltage which is a saturated voltage VsatB (=1.3V+Vtt). It is possible to match the grayscale value to an effective portion of a liquid crystal response curve.

Therefore, the liquid crystal display for R displays white color when the applied voltage of the liquid crystal LCM is (2.8V+Vtt) and displays block color when the applied voltage of the liquid crystal LCM is +Vtt. The liquid crystal display for G displays white color when the applied voltage of the liquid crystal LCM is (2.3V+Vtt) and displays block color when the applied voltage of the liquid crystal LCM is +Vtt. The liquid crystal display for B displays white color when the applied voltage of the liquid crystal LCM is (1.3V+Vtt) and displays block color when the applied voltage of the liquid crystal LCM is +Vtt.

In response to the above, the lower driving voltage V0 and the higher driving voltage V1 of the liquid crystal display for each color are determined. For example, the lower driving voltage V0 and the higher driving voltage V1 are respectively set to 0V and 2.8V in the liquid crystal display for R. The lower driving voltage V0 and the higher driving voltage V1 are respectively set to 0.5V and 2.8V in the liquid crystal display for G. The lower driving voltage V0 and the higher driving voltage V1 are respectively set to 0.75V and 2.75V in the liquid crystal display for B.

Alternately, the lower driving voltage V0 and the higher driving voltage V1 may be set to arbitrary values as analog voltages. Due to this, in the light of variation in a cell gap of the liquid crystal, it is possible to set the lower driving voltage V0 and the higher driving voltage V1 according to a display image in the assembled liquid crystal display.

As described the above, according to the present embodiment, the higher driving voltage V1 and the lower driving voltage V0 arbitrarily set between the ground potential and the power-supply voltage used in the device, are supplied to the pixel circuit 16. Thereby, it is possible to supply the higher driving voltage V1 and the lower driving voltage V0 each of which differs from the ground potential and the power-supply voltage. As the result, a driving voltage suitable for light-emitting display can be supplied to the liquid crystal LCM.

Since the first hold unit 161 is composed of the first transistor T1, the first inverter INV1 and the second inverter INV2, the first hold unit 161 can be realized by a downsized and simple configuration.

Since the driving force of the first inverter INV1 is set to be larger than the driving force of the second inverter INV2, data held in the first hold unit 161 can be surely and stably transferred to the second hold unit 163 and then held in the second hold unit 163.

Since the transfer control unit 162 is composed of the second transistor T2 which is a first conductive type and the third transistor T3 which is a second conductive type, data held in the first hold unit 161 can be surely transferred to the second hold unit 163 and then held in the second hold unit 163 without bringing voltage reduction.

Since the second hold unit 163 is composed of a capacitor, the second hold unit 163 can be realized by a downsized and simple configuration.

The liquid crystal display according to the present embodiment can be applied to a projection display which displays a color image using a three plate method, for example. In this case, the projection display includes a liquid crystal display for R (red color), a liquid crystal display for G (green color) and a liquid crystal display for B (blue color). The projection display performs a color display by optically-combining images displayed by the liquid crystal displays for respective colors.

Thus, when the liquid crystal display according to the present embodiment is applied to the projection display, the liquid crystal display for each color can use the higher driving voltages and the lower driving voltage which differ from those of the liquid crystal displays for other colors, as shown in FIG. 7.

Namely, the higher driving voltage V1R and the lower driving voltage V0R are supplied to the pixel circuits 16 in the liquid crystal display for R. The higher driving voltage V1G and the lower driving voltage V0G are supplied to the pixel circuits 16 in the liquid crystal display for G. The higher driving voltage V1B and the lower driving voltage V0B are supplied to the pixel circuits 16 in the liquid crystal display for B.

For each pair of higher and lower driving voltages, values suitable for driving a liquid crystal with each light-emitting wavelength are selected. Generally, it is necessary to set a larger driving voltage in this order of R, G and B. For example, a level relation for the higher driving voltages V1R, V1G and V1B has V1R>V1G>V1B, and a level relation for the lower driving voltages V0R, V0G and V0B has V0R<V0G<V0B.

As the result, it is possible to supply a suitable driving voltage according to each wavelength of light-emitting color, to the liquid crystals LCM of the pixel circuits 16 of the liquid crystal display for each color. This improves a dynamic range in color display, in comparison with the conventional color projection display with a three-plate method which supplies the ground potential and the power-supply voltage uniformly to the liquid crystal displays for respective colors.

Second Exemplary Embodiment

Figure 8:
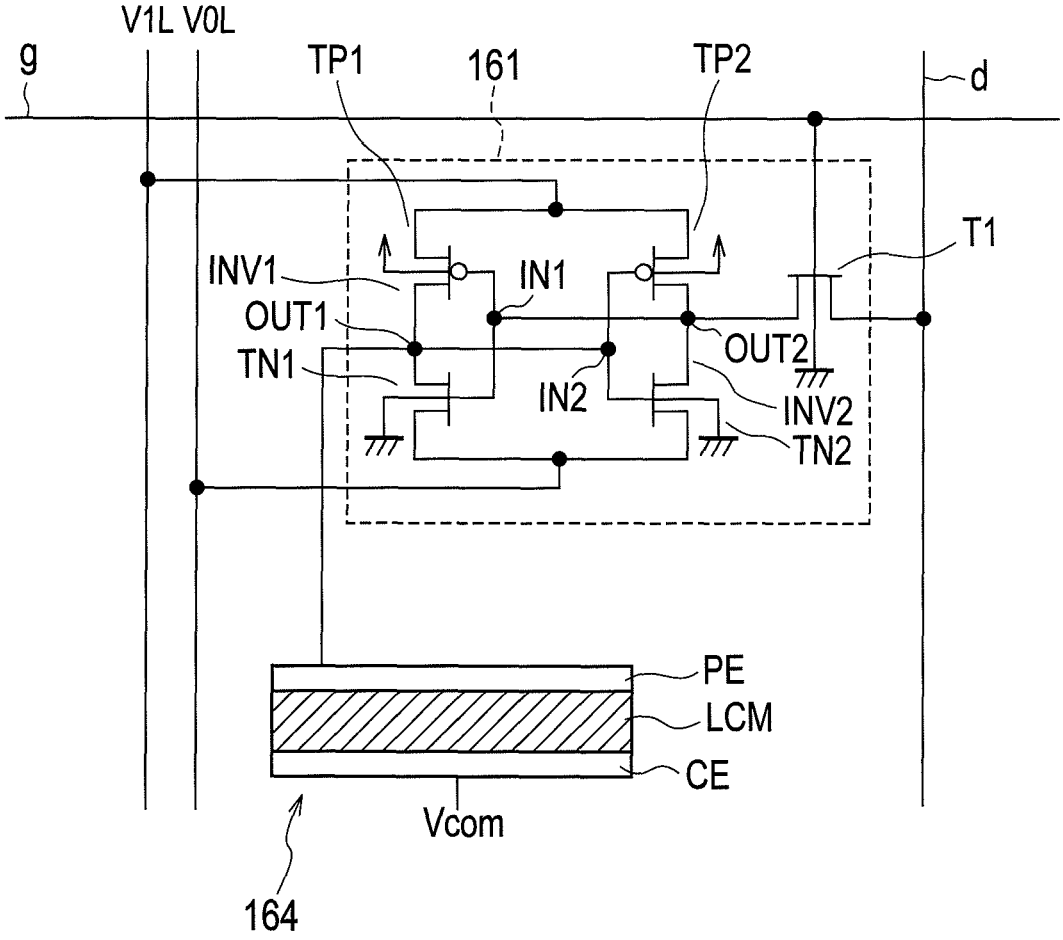
FIG. 8 is a diagram that illustrates a circuit configuration in a pixel circuit according to a second exemplary embodiment of the present invention.

The configuration of liquid crystal display according to the present embodiment will be described with reference to FIG. 8. In FIG. 8, the same sign is assigned to an element similar to the element shown in FIG. 2, and the description of the element is omitted.

As a difference between the liquid crystal display according to the present embodiment and the liquid crystal display according to the first exemplary embodiment, the configuration of the present embodiment is generated, by eliminating the transfer control unit 162 and the second hold unit 163 from each pixel circuit 16 of the first exemplary embodiment, and eliminating the normal trigger line "trig", and the inverted trigger line "trigb" with the elimination of the transfer control unit 162. Namely, in a pixel circuit 16 of the present embodiment, the output terminal OUT1 of the first inverter INV1 of the first hold unit 161 of the first exemplary embodiment is directly connected to the reflective electrode PE of the pixel unit 164.

Next, writing and reading operations of sub-frame data in the present embodiment will be described, with reference to a timing chart of FIG. 9.

In the liquid crystal display of the present embodiment, a row scanning line is sequentially selected by 1H unit one by one from the row scanning line g1 toward the row scanning line gm, according to a row scanning signal from the vertical shift register 13. Thereby, in the plurality of pixel circuits 16 forming the display unit 11, writing of sub-frame data is performed in n-pixel circuits 16 on one row commonly connected to the selected row scanning line.

FIG. 9(X) shows a case where the lower power-supply voltage GND=0V, the higher power-supply voltage VDD=3.3V, the lower driving voltage V0=0.5V and the higher driving voltage V1=2.8V in the following timing chart.

In such a potential relationship, the higher and lower power-supply voltages of the transistor other than those in the first hold unit 161 are 3.3V and 0V, respectively. The signal amplitude of sub-frame data is 3.3V. The amplitude between the higher driving voltage V1 and the lower driving voltage V0 is 2.3V. Therefore, the amplitude of data held in the first hold unit 161 is 2.3V.

FIG. 9(A) schematically shows a writing period and a reading period in one pixel circuit 16 for sub-frame data having 1-bit value to be output from the horizontal driver 15 to each of the column data lines d1 to dn. A diagonal line which is diagonally right down in FIG. 9(A) indicates the writing period.

It is noted that logics of bits Bob, B1*b* and B2*b* in inverted sub-frame data are opposite to logics of bits B0, B1 and B2 in normal sub-frame data. The normal sub-frame data with the bit B0 and the inverted sub-frame data with the bit B0*b* constitute one sub-frame (first sub-frame). In the first sub-frame, the first half which is a period between times T1 and T2 is set to have the same period as the last half which is a period between times T2 to T3.

The normal sub-frame data with the bit B1 and the inverted sub-frame data with the bit B1*b* constitute one sub-frame (second sub-frame). In the second sub-frame, the first half which is a period between times T3 and T4 is set to have the same period as the last half which is a period between times T4 to T5.

The normal sub-frame data with the bit B2 and the inverted sub-frame data with the bit B2*b* constitute one sub-frame (third sub-frame). In the third sub-frame, the first half which is a period between times T5 and T6 is set to have the same period as the last half which is a period between times T6 to T7.

Figure 9:
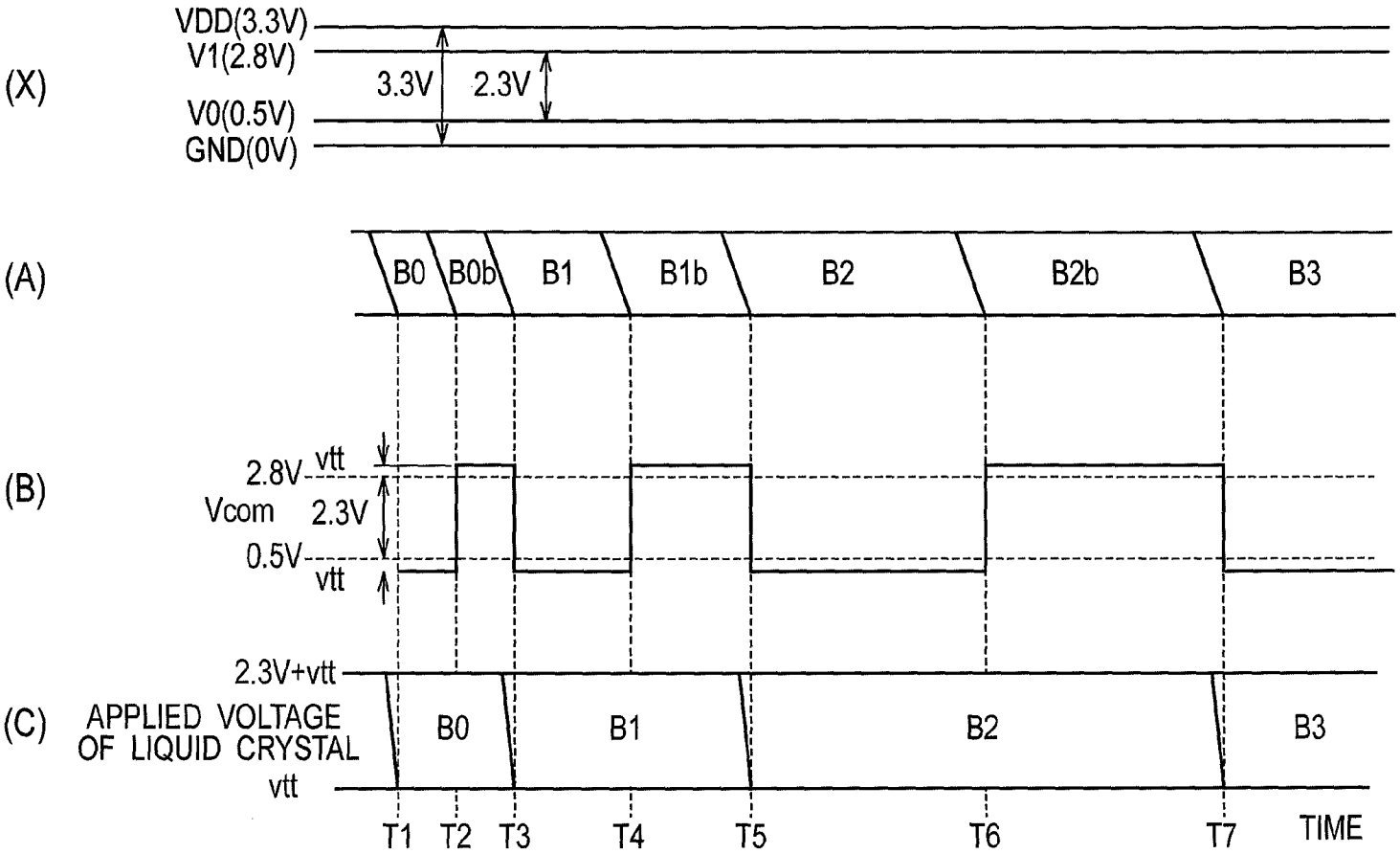
FIG. 9 is a timing chart that illustrates one example of a driving method of the liquid crystal display according to the second exemplary embodiment of the present invention.

In FIG. 9, the period (times T5 to T7) of the third sub-frame is set to have twice the longer of the period (times T3 to T5) of the second sub-frame. The period (times T3 to T5) of the second sub-frame is set to have twice the length of the period (times T1 to T3) of the first sub-frame. It is noted that each of the periods of the first to third sub-frames is not limited to the above, and may be arbitrarily set.

Although three sub-frames which are the first to third sub-frames are described in FIG. 9, the number of sub-frames may be arbitrarily set. One frame is composed of sub-frames whose the number is arbitrarily set.

In each of plural pixel circuits 16 on one row selected by the row scanning signal, the normal sub-frame data with the bit B0 shown in FIG. 9(A) output to the column data line d is written in the first hold unit 161 through the first transistor T1.

At this time, the signal amplitude of sub-frame data having 1-bit value output to each of the column data lines d1 to do is 3.3V. The signal amplitude of row scanning signal is also 3.3V. Thereby, sub-frame data having the L-level being 0V or the H-level being (3.3V−Vth) is input to the first hold unit 161. It is noted that Vth is a threshold voltage of a transistor employed in the pixel circuit 16, and has a value about 0.6V for example.

For example, when sub-frame data having the H-level is output to the column data line d, the voltage VOUT2 of the output terminal OUT2 of the second inverter INV2 has a value about 2.7V which is (3.3V−Vth). Since the voltage VOUT2 is a gate voltage of the transistor TP1, the voltage having the value about 2.7V is applied to the gate terminal of the transistor TP1. This indicates that the transistor TP1 does not completely become a conductive state.

In contrast, since the voltage VOUT2 having the value about 2.7V is considerably higher than the lower driving voltage V0, the transistor TN1 becomes a conductive state. This indicates that a voltage closer to 0V which is determined depending on a ratio of electric current flowing in the transistor TP1 to electric current flowing in the transistor TN1, is applied to gate terminals of the transistor TP2 and the transistor TN2. In this state, although a slight electric current flows through the first inverter INV1 and the second inverter INV2, the self-holding storage function normally works.

Then, when the first transistor T1 becomes a non-conductive state, the voltage VOUT2 shifts to the higher driving voltage V1 of 2.8V and the voltage VOUT1 shifts to the lower driving voltage V0 of 0.5V. This indicates that the first hold unit 161 holds data corresponding to sub-frame data with the amplitude of 2.3V which is switched between 0.5V and 2.8V.

In parallel with this writing operation, the data held in the output terminal OUT1 of the first inverter INV1 of the first hold unit 161, is read out to the pixel unit 164, and then applied to the reflective electrode PE of the pixel unit 164 connected to the first hold unit 161 in which the writing has been performed.

A level of the data held in the output terminal OUT1 of the first inverter INV1 of the first hold unit 161, is identical to the level obtained by inverting a level of sub-frame data output to the column data line d. Namely, when the sub-frame data has the L-level (0V), the data held in the output terminal OUT1 has the H-level (2.8V). When the sub-frame data has the H-level (3.3V), the data held in the output terminal OUT1 has the L-level (0.5V).

The writing operation and the reading operation are performed with respect to all pixel circuits 16 forming the display unit 11. Thereby, the writing of data corresponding to the normal sub-frame data with the bit B0 is performed in the first hold unit 161, and the written data is subsequently applied to the reflective electrode PE of the pixel unit 164. The operation in the first sub-frame is performed before time T1 shown in FIG. 9.

When a bit value of sub-frame data is 0, that is the sub-frame data has the L-level, the higher driving voltage V1 of 2.8V is applied to the reflective electrode PE. In contrast, when a bit value of sub-frame data is 1, that is the sub-frame data has the H-level, the lower driving voltage V0 of 0.5V is applied to the reflective electrode PE.

The common electrode voltage Vcom which is previously set depending on a voltage to be applied to the reflective electrode PE, is applied to the common electrode CE. After the writing of all pieces of sub-frame data is finished in all pixel circuits 16, the common electrode voltage Vcom is switched to a regular voltage value.

In the period between time T1 to time T2 of the first half of the first sub-frame, the common electrode voltage Vcom has the regular voltage value shown in FIG. 9(B). The regular voltage value is set to a voltage of (0.5−Vtt) which is lower than the lower driving voltage V0 of 0.5V by a threshold voltage Vtt of the liquid crystal LCM.

Thereby, an applied voltage of the liquid crystal LCM becomes a voltage of (2.3+Vtt) (=2.8−(0.5−Vtt)) when a bit value of the normal sub-frame data is 0 in the period between time "T1" and time "T2". In contrast, when a bit value of the normal sub-frame data is 1, an applied voltage of the liquid crystal "LCM" becomes a voltage of Vtt (=0.5−(0.5−Vtt)). Therefore, the absolute value of the applied voltage of the liquid crystal LCM has a value shown in FIG. 9(C).

In the first half of the first sub-frame, an operation for writing in the first hold unit 161, sub-frame data with the bit B0*b* shown in FIG. 9(A) in which the bits B0 is inverted, is performed. Namely, when a certain time in which plural pieces of normal sub-frame data with the bit B0 have been written in all pixel circuits 16 of the display unit 11 elapsed, the writing operation of the inverted sub-frame data with the bit B0*b* is performed. The writing operation of the inverted sub-frame data with the bit B0*b* is performed as well as the writing operation of the normal sub-frame data with the bit B0.

In the period between time T2 to time T3 of the last half of the first sub-frame after the writing operation of plural pieces of inverted sub-frame data with the bit B0*b* is completed in all pixel circuits 16 of the display unit 11, the common electrode voltage Vcom has the regular voltage value shown in FIG. 9(B). The regular voltage value is set to a voltage of (2.8+Vtt) which is higher than the higher driving voltage V1 of 2.8V by the threshold voltage Vtt of the liquid crystal LCM.

Thereby, an applied voltage of the liquid crystal LCM becomes a voltage of −Vtt (=2.8−(2.8+Vtt)) when a bit value of the normal sub-frame data is 0 in the period of the last half of the firs sub-frame. In contrast, when an bit value of the normal sub-frame data is 1, an applied voltage of the liquid crystal LCM becomes a voltage of −(2.3+Vtt) (=0.5−(2.8+Vtt)). Therefore, the absolute value of the applied voltage of the liquid crystal LCM has a value shown in FIG. 9(C). Namely, the absolute value of the applied voltage of the liquid crystal LCM has Vtt at the time when a bit value of the normal sub-frame data is 0, and has 2.3+Vtt at the time when a bit value of the normal sub-frame data is 1.

In the period between time T1 and time T2 of the first half of the first sub-frame, when a bit value of the normal sub-frame data with the bit B0 is 0, an applied voltage of the liquid crystal LCM becomes the voltage of (2.3+Vtt). In the period of the last half subsequent to the first half of the first sub-frame, a logical value of the inverted sub-frame data with the bit B0*b* is 1 which is opposite to the logical value of the normal sub-frame data with the bit B0. Therefore, an applied voltage of the liquid crystal LCM becomes the voltage of −(2.3+Vtt) in the period of the last half of the first sub-frame.

Thereby, the direction of potential applied to the liquid crystal LCM in the first half of the first sub-frame is opposite to the direction of potential applied to the liquid crystal LCM in the last half of the first sub-frame, and the absolute value of applied voltage in the first half of the first sub-frame is equal to the absolute value of applied voltage in the last half of the first sub-frame. Therefore, the pixel circuit 16 displays white color in the first half and the last half of the first sub-frame as shown in the grayscale value of FIG. 5.

In contrast, in the period between time T1 and time T2 of the first half of the first sub-frame, when a bit value of the normal sub-frame data with the bit B0 is 1, an applied voltage of the liquid crystal LCM becomes the voltage of +Vtt. In the period between time T2 and time T3 of the last half subsequent to the first half of the first sub-frame, a logical value of the inverted sub-frame data with the bit B0*b* is 0 which is opposite to the logical value of the normal sub-frame data with the bit B0. Therefore, the applied voltage of the liquid crystal LCM becomes the voltage of −Vtt in the period of the last half of the first sub-frame.

Thereby, the direction of potential applied to the liquid crystal LCM in the first half of the first sub-frame is opposite to the direction of potential applied to the liquid crystal LCM in the last half of the first sub-frame, and the absolute value of applied voltage in the first half of the first sub-frame is equal to the absolute value of applied voltage in the last half of the first sub-frame. Therefore, the pixel circuit 16 displays black color in the first half and the last half of the first sub-frame as shown in the grayscale value of FIG. 5.

As described above, although the bit value of the first sub-frame in the first half of the first sub-frame is opposite to that in the last half of the first sub-frame, display is performed with the same gradation in the first half and the last half of the first sub-frame. Further, the potential direction of the applied voltage of the liquid crystal LCM is inverted between the first half and the last half of the first sub-frame, which AC-drives the liquid crystal LCM. This prevents the liquid crystal LCM from being burned in.

In the last half of the first sub-frame, an operation for writing the normal sub-frame data with the bit B1 to the first hold unit 161 is performed. Namely, when a certain time in which plural pieces of inverted sub-frame data with the bit B0*b* have been written in all pixel circuits 16 of the display unit 11 elapsed, the writing operation of the normal sub-frame data with the bit B1 is performed. The writing operation of the normal sub-frame data with the bit B1 is performed as well as the writing operation of the normal sub-frame data with the bit B0.

In the period between time T3 and time T4 of the first half of the second sub-frame after the writing operation of plural pieces of normal sub-frame data with the bit B1 is completed in all pixel circuits 16, the common electrode voltage Vcom shifts to the same voltage value as the first half of the first sub-frame.

In the first half of the second sub-frame, an operation for writing the inverted sub-frame data with the bit B1*b* is performed. Namely, when a certain time in which plural pieces of normal sub-frame data with the bits B1 have been written in all pixel circuits 16 of the display unit 11 elapsed, the writing operation of the inverted sub-frame data with the bit B1*b* is performed. The writing operation of the inverted sub-frame data with the bit B1*b* is performed as well as the writing operation of the inverted sub-frame data with the bit B0*b*.

In the period between time T4 and time T5 of the last half of the second sub-frame after the writing operation of plural pieces of inverted sub-frame data with the bit B1*b* is completed in all pixel circuits 16, the common electrode voltage Vcom shifts to the same voltage value as the last half of the first sub-frame.

Therefore, while the lengths of writing period and reading period in the second sub-frame differs from the lengths of writing period and reading period in the first sub-frame, the direction and the absolute value of applied voltage of the liquid crystal LCM in the second sub-frame is the same as the first sub-frame. Due to this, in the second sub-frame, display is performed depending on two pieces of sub-frame data with bits B1 and B1*b* as well as the first sub-frame.

In the last half of the second sub-frame, an operation for writing the normal sub-frame data with the bit B2 is performed. Namely, when a certain time in which plural pieces of inverted sub-frame data with the bit B1*b* have been written in all pixel circuits 16 of the display unit 11 elapsed, the writing operation of the normal sub-frame data with the bit B2 is performed. The writing operation of the normal sub-frame data with the bit B2 is performed as well as the writing operation of the normal sub-frame data with the bit B0.

In the period between time T5 and time T6 of the first half of the third sub-frame after the writing operation of plural pieces of normal sub-frame data with the bit B2 is completed in all pixel circuits 16, the common electrode voltage Vcom shifts to the same voltage value as the first half of the first sub-frame.

In the first half of the third sub-frame, an operation for writing the inverted sub-frame data with the bit B2*b* is performed. Namely, when a certain time in which plural pieces of normal sub-frame data with the bit B2 have been written in all pixel circuits 16 of the display unit 11 elapsed, the writing operation of the inverted sub-frame data with the bit B2*b* is performed. The writing operation of the inverted sub-frame data with the bit B2*b* is performed as well as the writing operation of the inverted sub-frame data with the bit B0*b*.

In the period between time T6 and time T7 of the last half of the third sub-frame after the writing operation of plural pieces of inverted sub-frame data with the bit B2*b* is completed in all pixel circuits 16, the common electrode voltage Vcom shifts to the same voltage value as the last half of the first sub-frame.

Therefore, while the lengths of writing period and reading period in the third sub-frame differs from the lengths of writing period and reading period in the first sub-frame, the direction and the absolute value of applied voltage of the liquid crystal LCM in the third sub-frame is the same as the first sub-frame. Due to this, in the third sub-frame, display is performed depending on two pieces of sub-frame data with the bits B2 and B2*b* as well as the first sub-frame.

As described above, the liquid crystal display in the present embodiment can display an image of one frame composed of plural sub-frames, depending on a combination of plural pieces of sub-frame according to a gradation at a time of displaying the image.

The present embodiment can obtain the effect similar to the first exemplary embodiment.

The pixel circuit 16 employed in the present embodiment is composed of the first hold unit 161 and the pixel unit 164. This realizes the pixel circuit 16 with the small and simple configuration.

In the pixel circuit 16 employed in the present embodiment, the operation for writing and holding sub-frame data in the first hold unit 161 and the operation for reading data corresponding to the held sub-frame data and applying it to the liquid crystal LCM are performed in parallel. Further, in the display unit 11, the writing operation is sequentially performed from the pixel circuit 16 connected to the row scanning line g1 toward the pixel circuit 16 connected to the row scanning line gm.

In contrast, the common electrode voltage Vcom to be applied to the common electrode CE of the liquid crystal LCM is supplied after the writing operation is completed in all pixel circuits 16 of the display unit 11. Namely, a regular voltage depending on sub-frame data is supplied in a lump to all pixel circuits 16 of the display unit 11, as the common electrode voltage Vcom. The common electrode voltage Vcom further has different voltage values between the first half and the last half of sub-frame.

Due to this, at least, while sub-frame data corresponding to the first or last half of sub-frame is written, a common electrode voltage Vcom which does not correspond to the sub-frame data being written is supplied. Namely, the common electrode voltage Vcom does not match the level of sub-frame data being written. As the result, an applied timing of the common electrode voltage Vcom is shifted in a period of writing sub-frame data.

However, in a case where a time of writing sub-frame data to all pixel circuits 16 is shorter than a time of one sub-frame, burn-in of liquid crystal due to the shift of applied timing of the common electrode voltage Vcom can be ignored. For example, in a case where the number of pixel circuits 16 forming the display unit 11 is relatively small, the writing time of sub-frame data is shorter than the time of sub-frame. Therefore, the device in the present embodiment can be applied to a liquid crystal display in which the number of pixel circuits 16 (number of pixels) is relatively small.

What is claimed is:

1. A liquid crystal display comprising:

a display configured to drive pixel circuits to display an image of one frame according to a gradation to be displayed, by combination of sub-frames each of which has a display period shorter than one frame period, wherein the pixel circuits are arranged on cross-points where each of column data lines intersects row scanning lines;

a horizontal scanning unit configured to sequentially output to the column data lines by one horizontal scanning period unit, data associated with the image of one frame;

a vertical scanning unit configured to output a row selection signal for sequentially selecting the row scanning lines one by one by one horizontal scanning period unit; and a trigger pulse generator configured to output a trigger pulse to the pixel circuits in common, wherein each of the pixel circuits comprises:

a first hold unit including a first transistor, a first inverter and a second inverter, the first transistor having a gate terminal connected to one of the row scanning lines and a drain terminal connected to one of the column data lines, and the first and second inverters to which a higher driving voltage and a lower driving voltage arbitrarily set between a power-supply voltage and a ground voltage are supplied, and to which the power-supply voltage and the ground voltage are supplied as a well potential, and the first hold unit configured to selectively hold the higher or lower driving voltage according to the row selection signal output from the vertical scanning unit via the one row scanning line and a logical value of the data output from the horizontal scanning unit via the one column data line;

a second hold unit configured to selectively hold the higher or lower driving voltage held in the first hold unit;

a transfer control unit configured to transfer to the second hold unit, the higher or lower driving voltage held in the first hold unit according to the trigger pulse; and a pixel unit configured to drive a liquid crystal according to a potential difference between the higher or lower driving voltage held in the second hold unit and a voltage supplied to a common electrode thereof, wherein the first inverter has an input terminal connected to an output terminal of the second inverter and a source terminal of the first transistor, and an output terminal connected to an input terminal of the second inverter and the transfer control unit, and and wherein the second inverter has the input terminal connected to the output terminal of the first inverter and the transfer control unit, and the output terminal connected to the input terminal of the first inverter and the source terminal of the first transistor.

2. The liquid crystal display according to claim 1, wherein:

a p-well terminal and a source terminal of a MOS type N-channel in the first and second inverters are separately formed, and an n-well terminal and a source terminal of a MOS type P-channel in the first and second inverters are separately formed.

3. The liquid crystal display according to claim 2, wherein a driving force of the first inverter is larger than one of the second inverter.

4. The liquid crystal display according to claim 1, wherein the transfer control unit comprises a second transistor and a third transistor which are conductively controlled according to the trigger pulse, have source terminals connected to each other, and have drain terminals connected to each other.

5. The liquid crystal display according to claim 1, wherein the second hold unit is a capacitor.

6. A liquid crystal display comprising:

a display configured to drive pixel circuits to display an image of one frame according to a gradation to be displayed, by combination of sub-frames each of which has a display period shorter than one frame period, wherein the pixel circuits are arranged on cross-points where each of column data lines intersects row scanning lines;

a horizontal scanning unit configured to sequentially output to the column data lines by one horizontal scanning period unit, data associated with the image of one frame; and a vertical scanning unit configured to output a row selection signal for sequentially selecting the row scanning lines one by one by one horizontal scanning period unit, wherein each of the pixel circuits comprises:

a first hold unit including a first transistor, a first inverter and a second inverter, the first transistor having a gate terminal connected to one of the row scanning lines and a drain terminal connected to one of the column data lines, and the first and second inverters to which a higher driving voltage and a lower driving voltage arbitrarily set between a power-supply voltage and a ground voltage are supplied, and to which the power-supply voltage and the ground voltage are supplied as a well potential, and the first hold unit configured to selectively hold the higher or lower driving voltage according to the row selection signal output from the vertical scanning unit via the one row scanning line and a logical value of the data output from the horizontal scanning unit via the one column data line; and a pixel unit configured to drive a liquid crystal according to a potential difference between the higher or lower driving voltage held in the first hold unit and a voltage supplied to a common electrode thereof, wherein the first inverter has an input terminal connected to an output terminal of the second inverter and a source terminal of the first transistor, and an output terminal connected to an input terminal of the second inverter and the associated pixel circuit, and and wherein the second inverter has the input terminal connected to the output terminal of the first inverter and the associated pixel circuit, and the output terminal connected to the input terminal of the first inverter and the source terminal of the first transistor.

7. The liquid crystal display according to claim 6, wherein:

a p-well terminal and a source terminal of a MOS type N-channel in the first and second inverters are separately formed, and an n-well terminal and a source terminal of a MOS type P-channel in the first and second inverters are separately formed.

* * * * *